US006601880B2

(12) United States Patent
Marois et al.

(10) Patent No.: US 6,601,880 B2
(45) Date of Patent: Aug. 5, 2003

(54) METHOD AND APPARATUS FOR MAKING A KNOT WITH FLEXIBLE MATERIAL WRAPPED AROUND AN ARTICLE

(75) Inventors: Yanick Marois, Fleurimont (CA); Guy Lopes, Sherbrooke (CA); Glen Ditchburn, Ayer's Cliff (CA); Sylvain Samson, Ayer's Cliff (CA); François Couture, Stanstead (CA); Alec van Zuiden, Stanstead (CA); Wolfgang Geisinger, Victoria (CA)

(73) Assignee: Wulftec International Inc., Ayer's Cliff (CA)

( * ) Notice: Subject to any disclaimer, the term of this patent is extended or adjusted under 35 U.S.C. 154(b) by 0 days.

(21) Appl. No.: 10/135,739

(22) Filed: Apr. 30, 2002

(65) Prior Publication Data

US 2003/0001389 A1 Jan. 2, 2003

Related U.S. Application Data

(60) Provisional application No. 60/317,523, filed on Sep. 7, 2001, and provisional application No. 60/287,375, filed on May 1, 2001.

(51) Int. Cl.[7] ..... A01D 59/04

(52) U.S. Cl. ..... 289/2; 289/1.5

(58) Field of Search ..... 289/1.2, 1.5, 2, 289/5, 6, 7, 8, 12, 17, 18.1; 53/414, 430, 580, 581, 582, 587, 588, 589, 590

(56) References Cited

U.S. PATENT DOCUMENTS

| | | | | | |
|---|---|---|---|---|---|
| 2,947,558 | A | * | 8/1960 | Bethune, Jr. | 289/2 |
| 3,359,023 | A | * | 12/1967 | Aubery | 289/2 |
| 3,570,553 | A | | 3/1971 | Bartilson | 140/93 |
| 3,752,517 | A | | 8/1973 | Warmack | 289/17 |
| 3,787,081 | A | * | 1/1974 | Macy | 289/17 |
| 3,915,483 | A | | 10/1975 | Pierce, Jr. | 289/16 |
| 4,223,516 | A | | 9/1980 | Vansteelant | 56/343 |
| 4,420,177 | A | | 12/1983 | Munro et al. | 289/14 |
| 4,573,719 | A | * | 3/1986 | Aldridge | 289/17 |
| 4,765,082 | A | | 8/1988 | Nicholas | 43/4 |
| 4,795,201 | A | | 1/1989 | Prellwitz et al. | 289/1.5 |
| 4,872,240 | A | | 10/1989 | Spinner et al. | 16/114 |
| 5,070,779 | A | * | 12/1991 | Molitorisz | 100/31 |
| 5,088,270 | A | | 2/1992 | Diehl | 53/399 |
| 5,197,217 | A | | 3/1993 | Browning | 43/4 |
| 5,236,232 | A | | 8/1993 | Broberg | 289/1.5 |
| 5,240,295 | A | | 8/1993 | Spencer | 289/1.5 |
| 5,690,369 | A | * | 11/1997 | Steck, III | 289/17 |
| 5,728,109 | A | | 3/1998 | Schulze et al. | 606/139 |
| 5,787,691 | A | | 8/1998 | Turfan et al. | 53/588 |
| 5,802,810 | A | | 9/1998 | Wojcik et al. | 53/399 |
| 5,878,555 | A | | 3/1999 | Turfan et al. | 53/588 |
| 5,971,447 | A | | 10/1999 | Steck, III | 289/17 |
| 6,143,006 | A | | 11/2000 | Chan | 606/148 |
| 6,195,968 | B1 | | 3/2001 | Marois et al. | 53/588 |

FOREIGN PATENT DOCUMENTS

| | | | |
|---|---|---|---|
| GB | 1095000 | 9/1965 | B65B/13/26 |

OTHER PUBLICATIONS

PCT International Search Report corresponding to PCT/CA02/00636. Date of mailing Aug. 21, 2002.

* cited by examiner

*Primary Examiner*—Gary L. Welch
(74) *Attorney, Agent, or Firm*—Myers Bigel Sibley & Sajovec, PA

(57) ABSTRACT

The method and apparatus are for making a knot with first and second rope-shaped end portions of flexible material wrapped around an article. The method comprises steps of (a) guiding the end portions along a predetermined path; (b) (i) nipping the first end portion at a first point of the predetermined path, (ii) nipping the second end portion at a second point of the predetermined path, and (iii) nipping the second end portion at a third point of the predetermined path; (c) cutting the second end portion between the second and third points to obtain a free end thereof; (d) moving the end portions to obtain a loop; (e) releasing the first end portion from the guiding of step (a) to obtain a free end thereof; and (f) inserting the free ends into the loop to form and tighten the knot.

16 Claims, 46 Drawing Sheets

METHOD AND APPARATUS FOR MAKING A KNOT WITH FLEXIBLE MATERIAL WRAPPED AROUND AN ARTICLE

RELATED APPLICATION

This application claims priority from U.S. Provisional Application 60/287,375, filed May 1, 2001 and U.S. Provisional Application 60/317,523, filed Sep. 7, 2001, the disclosures of which are incorporated by reference herein in their entireties.

FIELD OF THE INVENTION

The present invention is concerned with a method and an apparatus for making a knot with two end portions of flexible material wrapped around an article.

BACKGROUND OF THE INVENTION

It is well known in the art that articles or products are wrapped with stretched film and that nothing else is required other than a brush to wipe the last tail. When stretched film is used, the static generated as it is stretched and the tacky material added to one side of the film make the tail stick to the layer previously applied. This method is appropriate when the article is shipped in a closed trailer or container but is inadequate when the product is shipped on an open trailer or stored outside because the tails are prone to getting loose as they are exposed to wind or bad weather.

In other applications, the articles are wrapped and then the tails are heat-sealed to previously applied layers of film. This well known technology is very popular. The seal is achieved by heating a heat pad which is brought in contact with the tail and previously applied layers of film. The film then melts in order to bond layers together. However, this method has some limitations. When the heat is applied to the film layers to create melting, holes can be created through all layers which remove the water proof protection of the product and/or can damage the product.

Known in the art, there is the U.S. Pat. No. 4,223,516, naming as inventor Marc G. VANSTEELANT, wherein there is described a knotter primarily for use with a crop baling machine. This knotter includes a rotatable twine holder for gripping the primary and secondary portions of twine and holding them in a side-by-side relationship extending along a predetermined path. A rotatable billhook is mounted adjacent to the twine holder and positioned to intersect the predetermined path. Drive means interconnecting the twine holder and billhook rotate the two elements in timed relation such that during a first cycle of the billhook the twine portions are positioned thereabout, and during a second cycle of the billhook a knot is tied therein.

Also known in the art, there is the U.S. Pat. No. 5,240,295 naming as inventor Donald R. SPENCER, wherein there is described a device which facilitates tying knots, particularly blood knots joining sections of a leader for a fishing line. The device includes a flexible frame having a base and left and right legs which project away from the base, there being a gap between the two legs. The frame carries a post which projects from the base into the gap intermediate the two legs and may be extended or retracted and even withdrawn. The legs carry winders which rotate about a common axis. Each winder has a hollow interior, a winding arm located at the gap, and a gripping sleeve remote from the gap. Lines or lengths of leader are inserted through the hollow interior of each winder and engaged with the winder arm of the other winder. When the winders are rotated, their arms twist the lines around each other, but the post forms a separation or opening in the wound region of the lines. The tag ends of the lines are inserted through the separation to produce a blood knot which is pulled tight.

Also known in the art, there is the U.S. Pat. No. 5,088,270 naming as inventor Werner K DIEHL, wherein there is described a heat seal assembly and method for securing stretch-film wrapped about a package, which assembly grasps and aligns two strips of roped film wraps, heats adjacent faces of the roped film sections and thereafter compresses these heated faces to weld them to each other and secure the film wrap about the package.

Also known in the art, there is the U.S. Pat. No. 6,195,968 naming Yanick MAROIS et al. as inventors, wherein there is described an apparatus for wrapping a load with a flexible wrapping material which prevents the flexible material from unwrapping itself after the load has been wrapped. The apparatus includes a first finger and a gripper for positioning a portion of a first rope supplied by the supplying means at a predetermined location. Once the load has been wrapped, a second finger and a guide wheel are provided to position a portion of a second rope supplied by the supply means at the predetermined position. The first and second ropes are fastened together at the predetermined position, and a portion of the second rope is cut downstream of the predetermined position.

Also known in the art, there are the following U.S. patents which describe different apparatuses and methods for making a knot: U.S. Pat. Nos. 3,570,553; 3,752,517; 3,915,483; 4,420,177; 4,765,082; 4,795,201; 4,872,240; 5,197,217; 5,236,232; 5,728,109; 5,787,691; 5,802,810; 5,878,555; 5,971,447; and 6,143,006.

A drawback with systems or methods of the prior art is that none of them is concerned with a method of making a knot with two end portions of flexible material wrapped around an article in a simple and efficient manner.

An object of the present invention is to provide a method and an apparatus for making a knot with two end portions of flexible material wrapped around an article in a manner that is simpler and more efficient than those provided in prior art.

It is also an object of the present invention to provide an apparatus and a method for making a knot with two end portions of flexible material wrapped around an article in an automated manner so that the apparatus and method can be applied to successive articles without any manual intervention of an operator.

SUMMARY OF THE INVENTION

According to the present invention, there is provided a method of making a knot with first and second rope-shaped end portions of flexible material wrapped around an article, comprising steps of: (a) guiding the end portions along a predetermined path; (b) (i) nipping the first end portion at a first point of the predetermined path, (ii) nipping the second end portion at a second point of the predetermined path, and (iii) nipping the second end portion at a third point of the predetermined path; (c) cutting the second end portion between the second and third points to obtain a free end thereof; (d) moving the end portions to obtain a loop; (e) releasing the first end portion from the guiding of step (a) to obtain a free end thereof; and (f) inserting the free ends into the loop to form and tighten the knot.

According to the present invention, there is also provided an apparatus for making a knot with first and second rope-shaped end portions of flexible material wrapped around an article, comprising: a controllable holder for holding a free end of the first end portion; controllable guides for guiding the end portions along a predetermined path; first controllable nippers for nipping the first end portion at a first point of the predetermined path; second controllable nippers for nipping the second end portion at a second point of the predetermined path; third controllable nippers for nipping the second end portion at a third point of the predetermined path; a controllable cutter for cutting the second end portion between the second and third points to obtain a free end thereof; first controllable moving means for moving the end portions to obtain a loop; and second controllable moving means for moving the free ends into the loop to form and tighten the knot.

The objects, advantages and other features of the present invention will become more apparent upon reading of the following non-restrictive description of preferred embodiments thereof, given for the purpose of exemplification only with reference to the accompanying drawings.

DETAILED DESCRIPTION OF PREFERRED EMBODIMENTS

Figure 1:
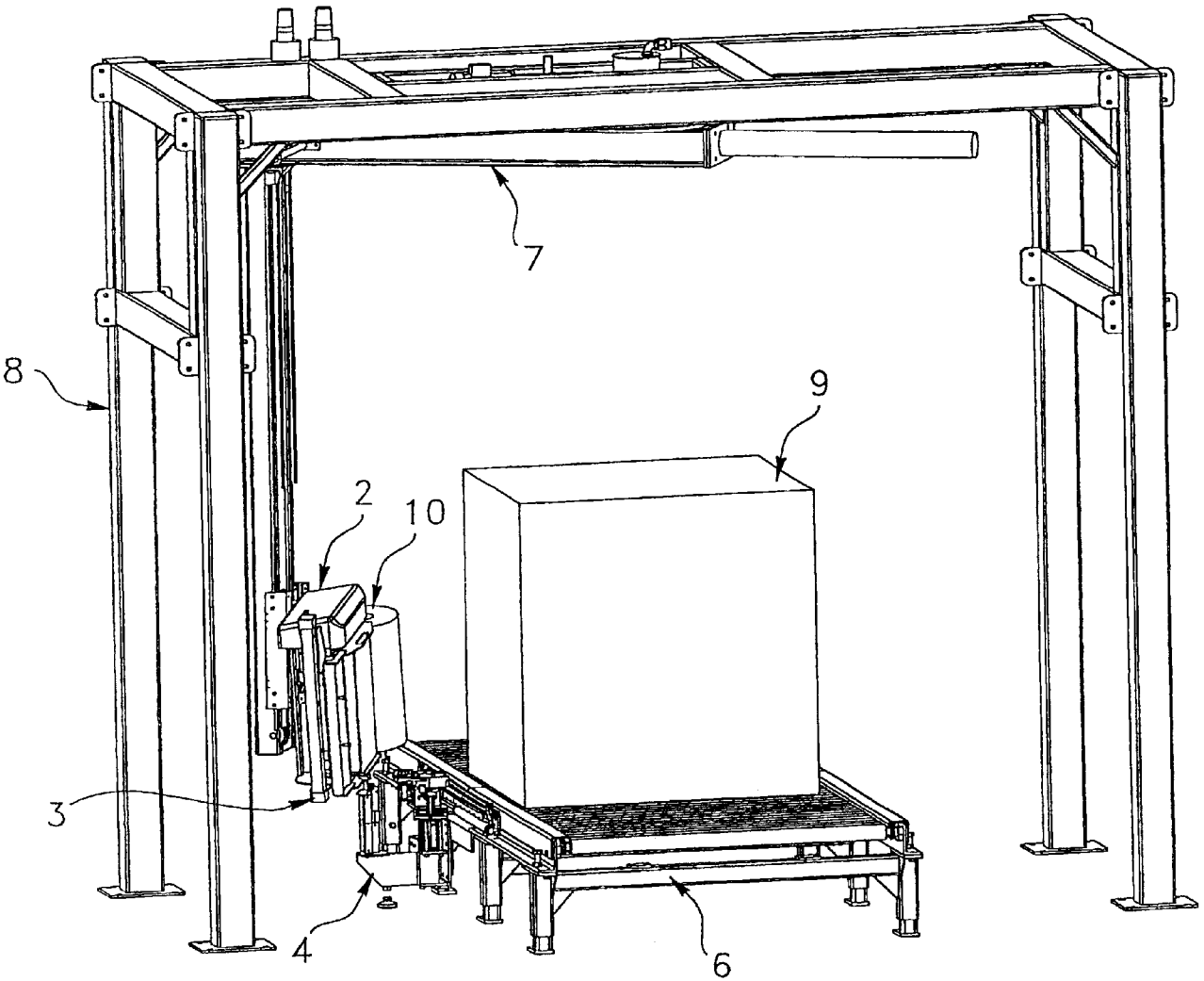
FIG. 1 is a perspective view of a wrapping machine provided with a first preferred embodiment of the present invention.
Figure 2:
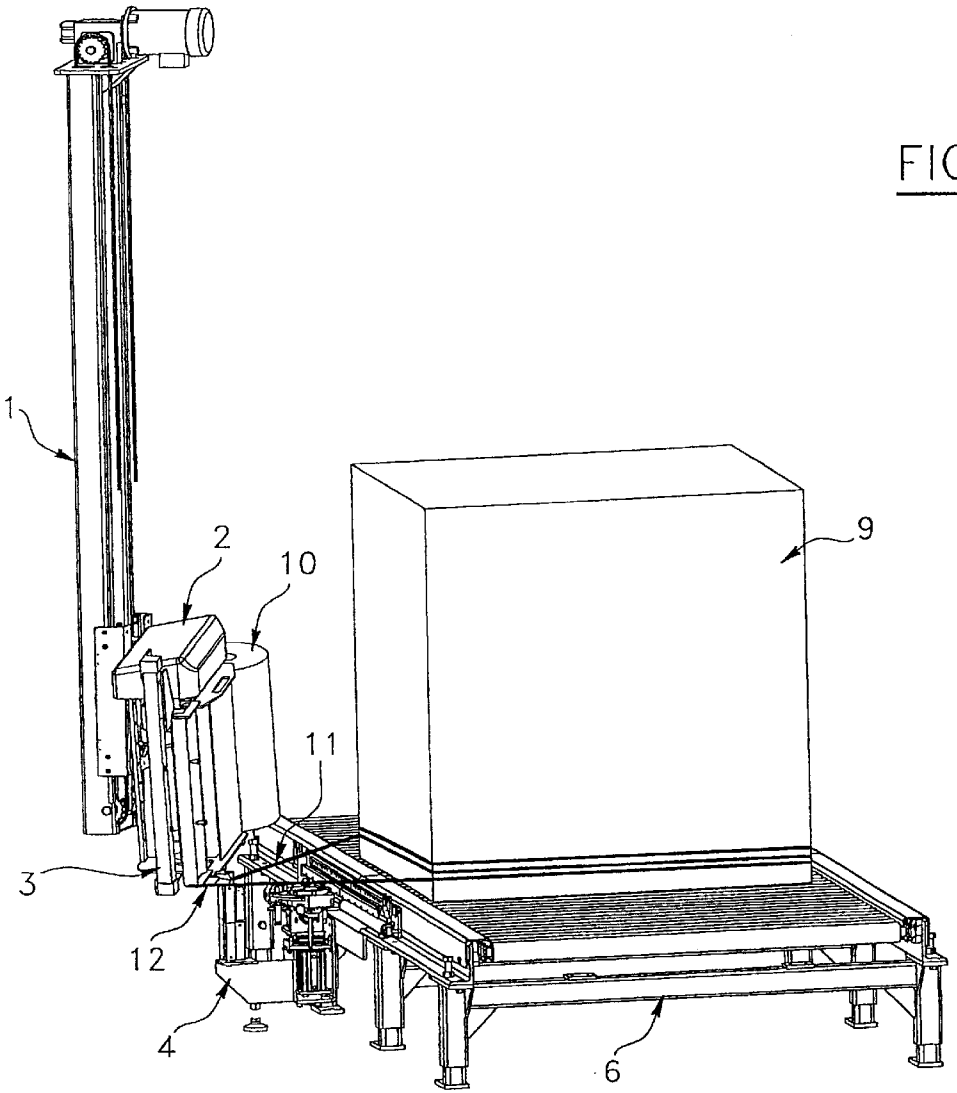
FIG. 2 is a partial perspective view of the wrapping machine provided with the first preferred embodiment according to the present invention in a first operating position.

Referring now to FIGS. 1 to 23, there is shown a first preferred embodiment of an apparatus according to the present invention within the environment in which it operates. Please find hereunder the numeral list of the components illustrated in FIGS. 1 to 23:

| | |
|---|---|
| 1. Vertical boom | 15. Actuator |
| 2. Film delivering carriage | 16. Right groove-shaped stop |
| 3. Roping assembly | 17. Tilt arm right |
| 4. Knotter assembly | 18. Pivot plate |
| 6. Conveyor | 19. Idler sprocket |
| 7. Rotary arm | 20. Main plate |
| 8. Frame | 21. Linear guide |
| 9. Article | 22. Actuator |
| 10. Film roll | 23. Crowder jib |
| 11. First end portion | 24. Tilt arm left |
| 12. Second end portion | 25. Cam follower |
| 26. Chain | 64. Swivel arm |
| 27. Left groove-shaped stop | 65. Shouldered sleeve |
| 28. Chain connector | 66. Tapered sleeve |
| 29. Tension screw | 67. Fixed jaw |
| 30. Left linear bearing | 68. Movable jaw |
| 31. Right linear bearing | 69. Finger |
| 32. Cam follower | 70. Roller |
| 33. Idler sprocket | 71. Main table |
| 50. Motor | 72. Movable jaw |
| 51. Rotary actuator | 73. Tail gripper mounting base |
| 53. Cut wire fork | 75. Proximity sensor |
| 54. Wire tension spring | 76. Bias shoulder |
| 55. Wire holder | 77. Fixed jaw |
| 56. Top clamp jaw | 78. Mounting plate |
| 57. Bottom clamp jaw | 80. Conveyor mounting angle member |
| 58. Clamp assembly plate | 81. Tail gripper actuator |
| 59. Cut wire | 85. Tail puller actuator |
| 60. Actuator | 88. Second rope |
| 61. Clamp actuator | 90. Pinion bevel gear |

-continued

| | |
|---|---|
| 62. Cut wire actuator | 92. Tail gripper actuator |
| 63. Leveling leg | 94. Home proximity sensor |

The apparatus is for making a knot with first and second rope-shaped end portions 11 and 12 of flexible material 10 wrapped around an article 9. The first preferred embodiment comprises a controllable holder for holding the free end of the first end portion. Preferably, the holder consists of a gripper comprising first and second jaws 57 and 56. The second jaw 56 is movable with respect to the first jaw 57 between a first position where the second jaw 56 operatively rests against the first jaw 57 as shown for example in FIG. 9 and a second position where the second jaw 56 is away from the first jaw 57 as shown for example in FIG. 14. The gripper also comprises an actuating element which is a top clamp jaw actuator 60 connected to the second jaw 56 for moving it between its first and second positions.

Figure 3:
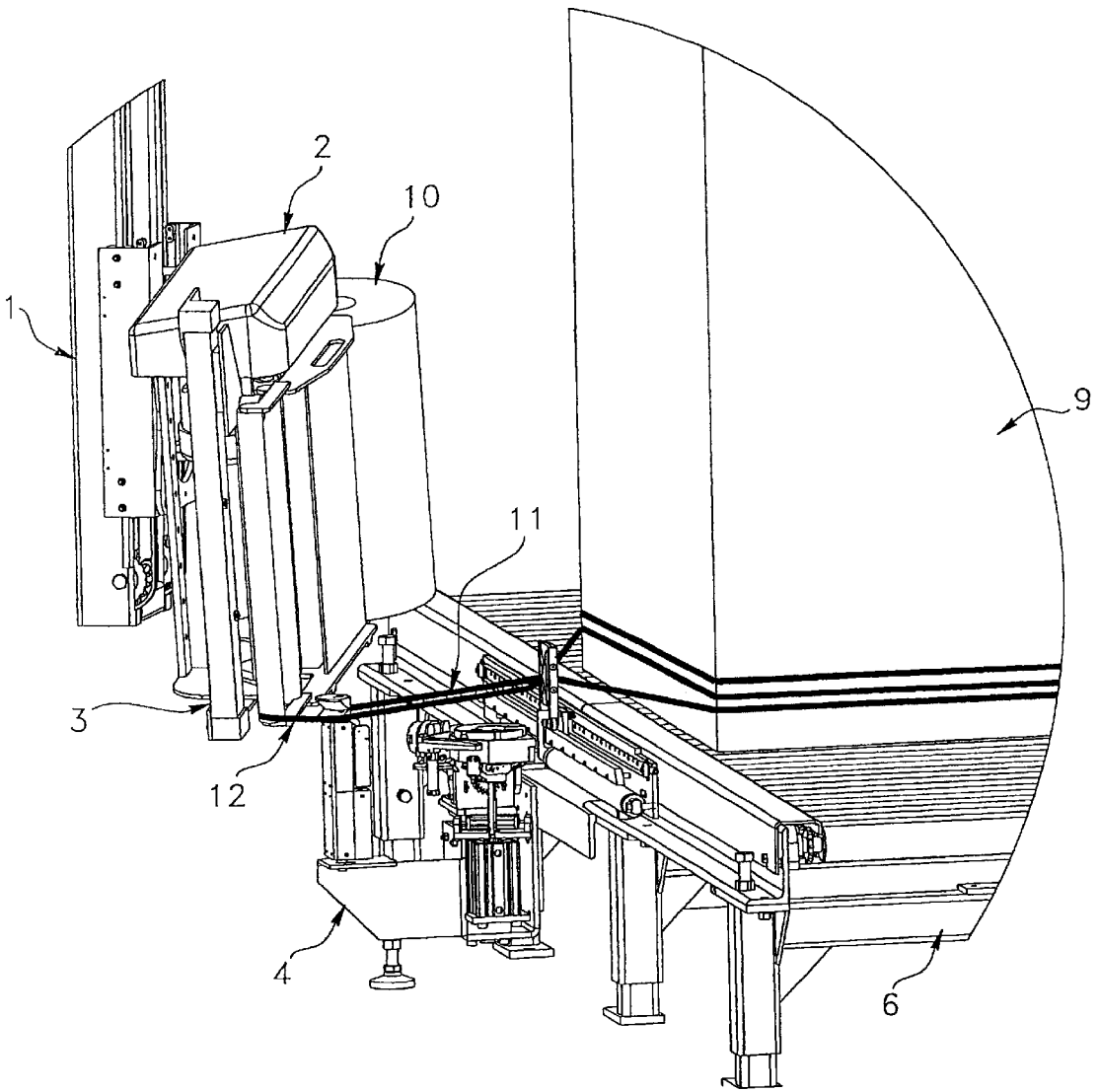
FIG. 3 is a partial perspective view of the wrapping machine provided with the first preferred embodiment according to the present invention in a second operating position.
Figure 4:
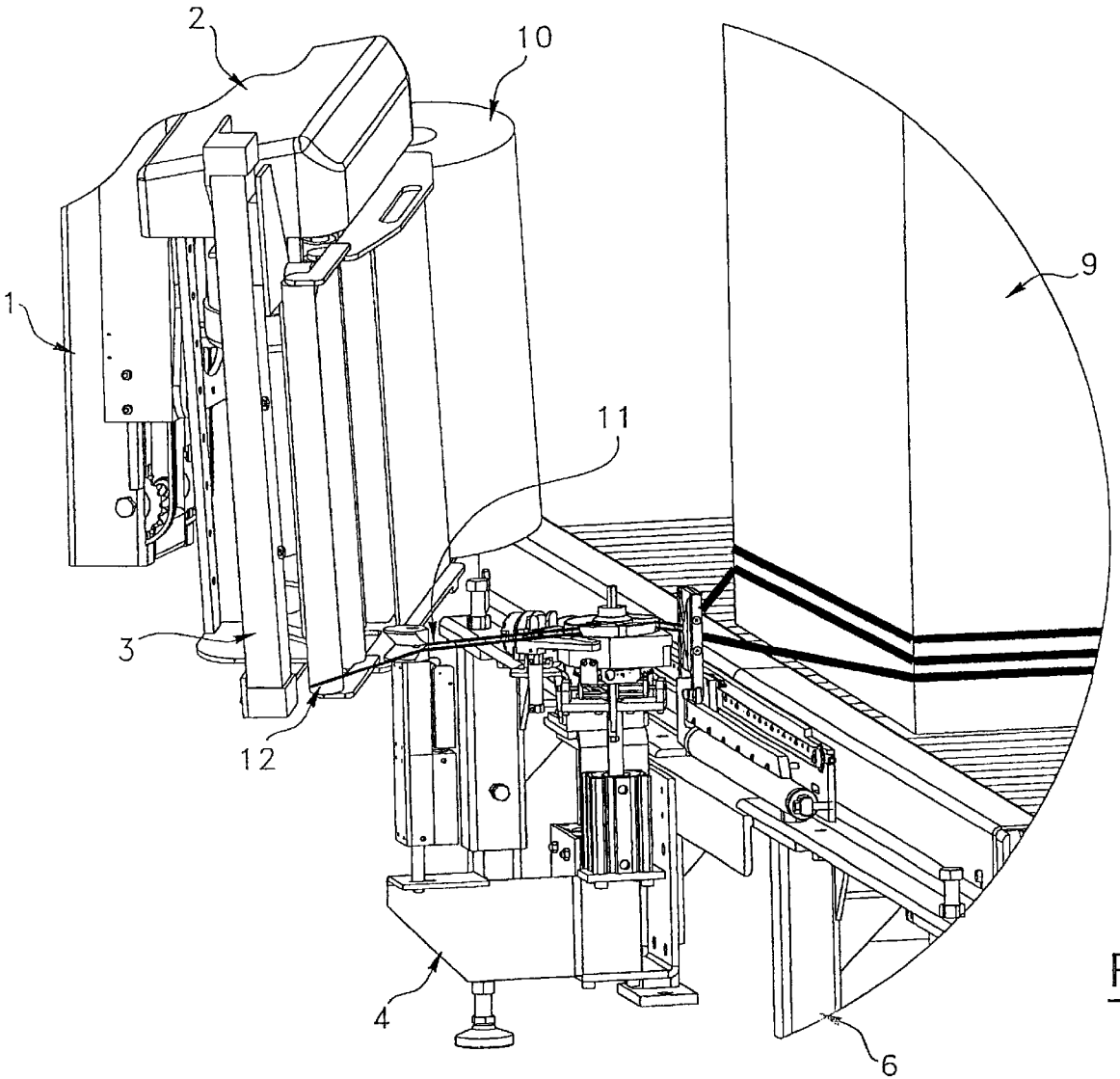
FIG. 4 is a partial perspective view of the wrapping machine provided with the first preferred embodiment according to the present invention in a third operating position.
Figure 5:
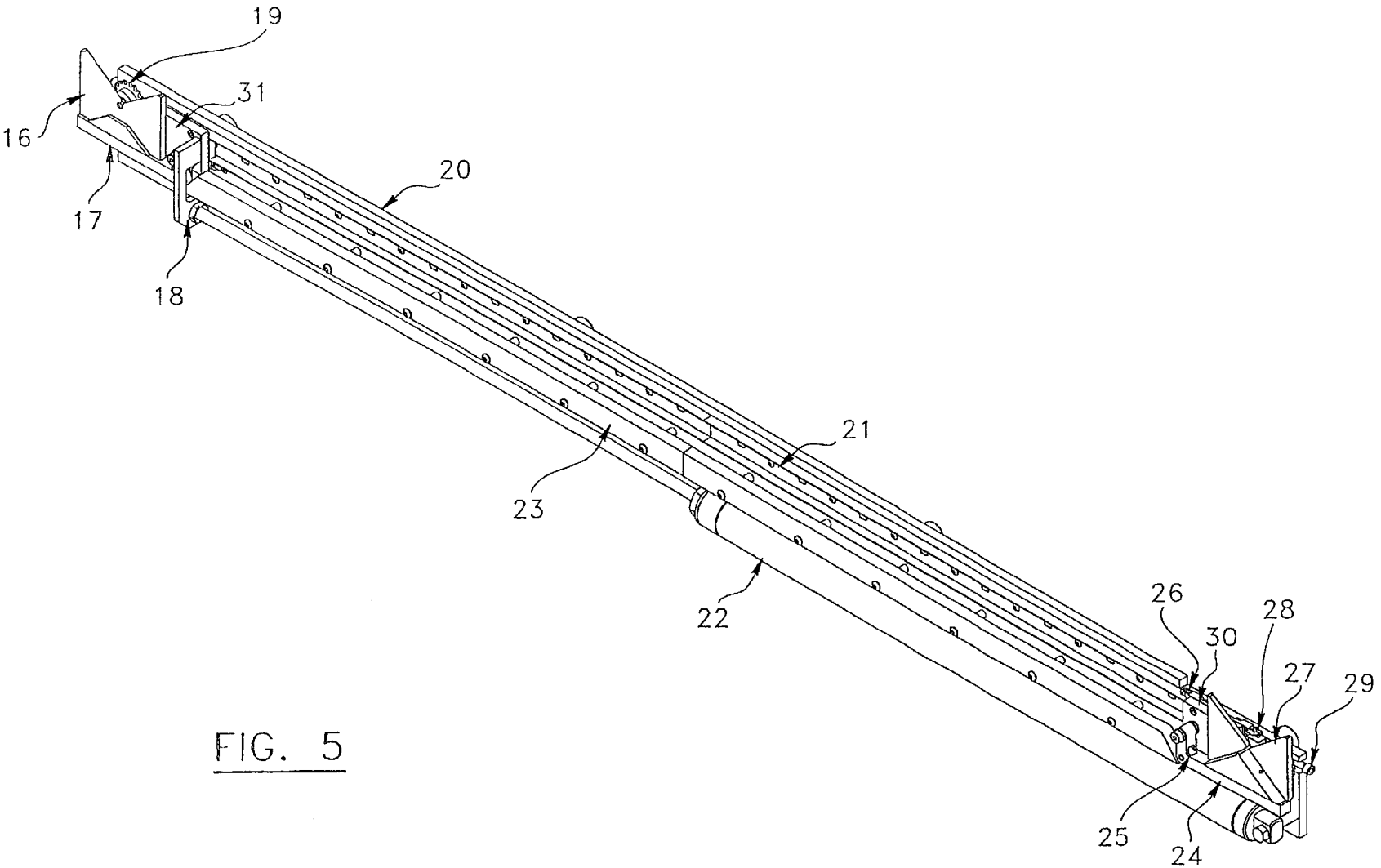
FIG. 5 is a perspective view of an element of the first preferred embodiment in a first operating position.
Figure 6:
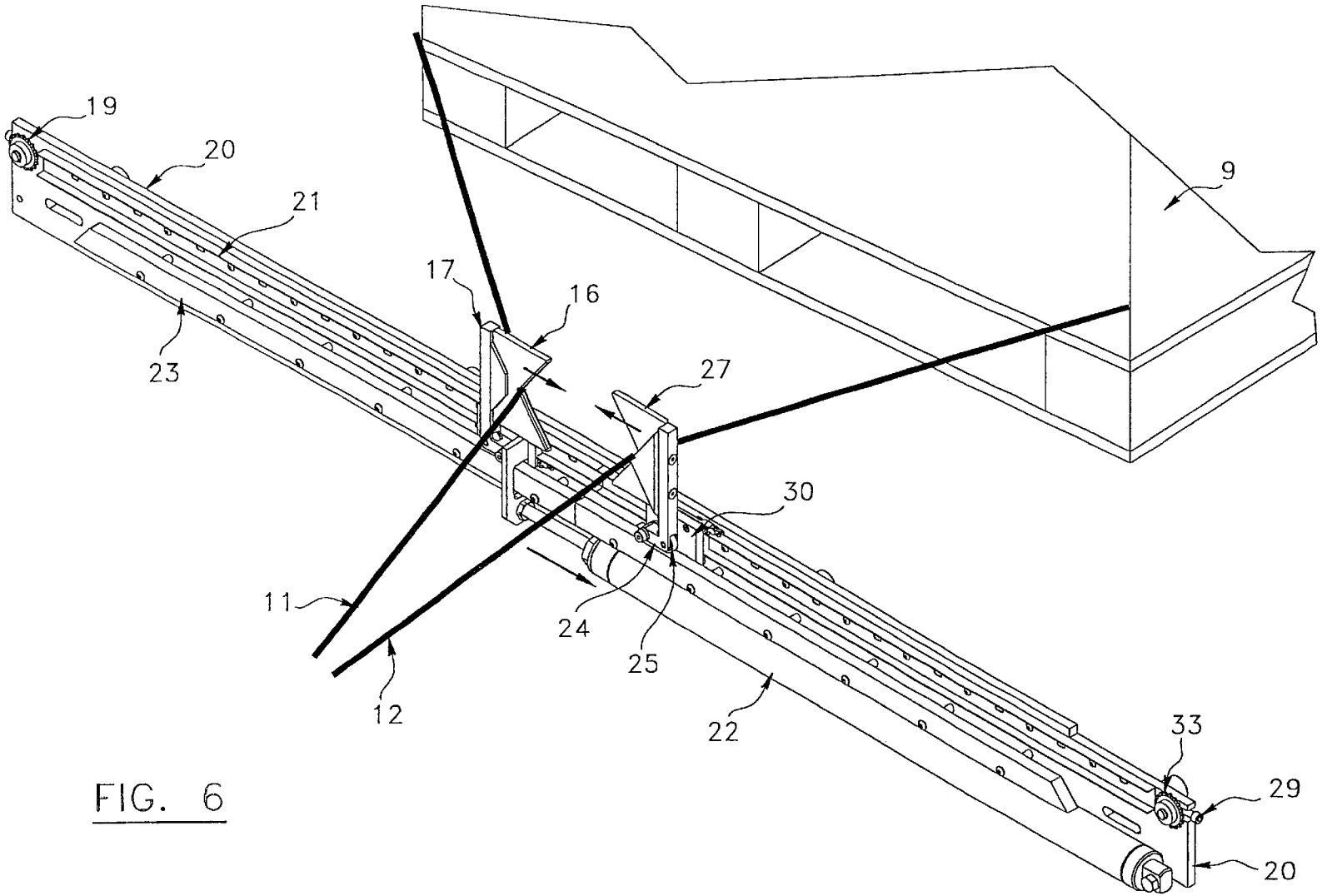
FIG. 6 is a perspective view of the element shown in FIG. 5 in a second operating position, in relation with the wrapped article.
Figure 7:
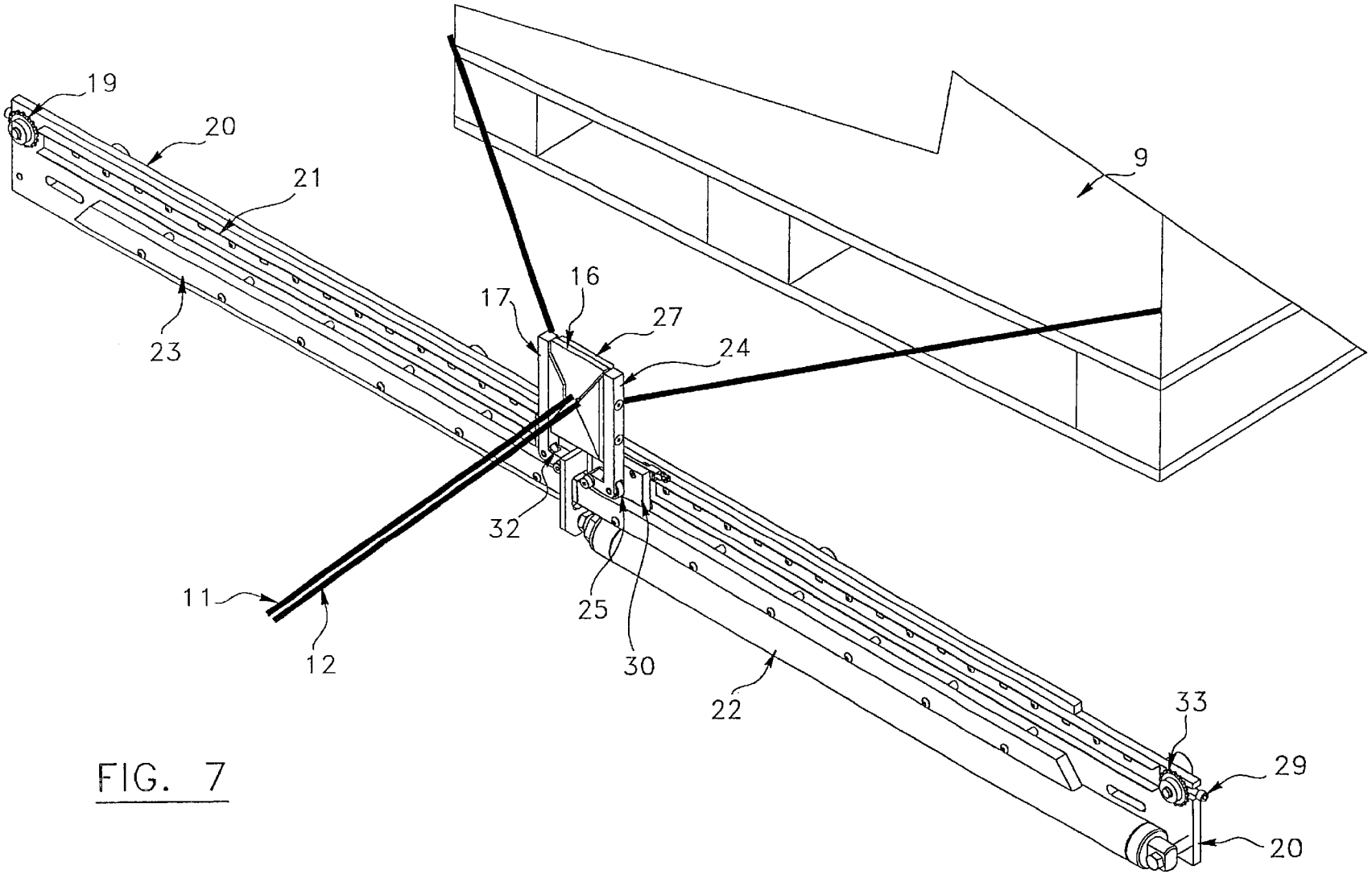
FIG. 7 is a perspective view of the element shown in FIGS. 5 an 6 in a third operating position, in relation with the wrapped article.
Figure 8:
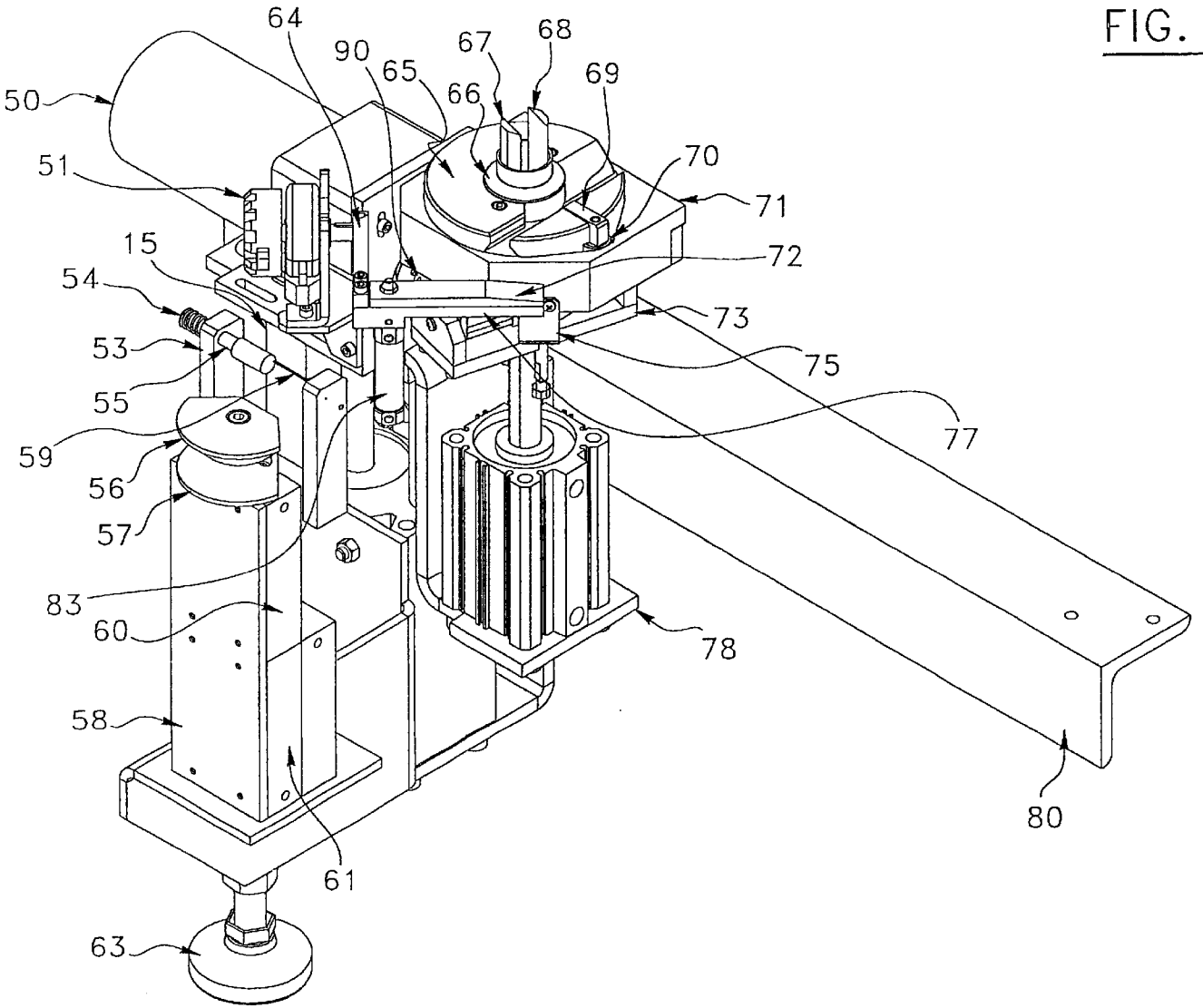
FIG. 8 is a general perspective view of another element of the first preferred embodiment.

The apparatus also comprises controllable guides for guiding the end portions 11 and 12 along a predetermined path as shown for example in FIG. 3. Preferably, the controllable guides comprise a groove-shaped element formed by the first and second jaws 57 and 56 when said second jaw 56 is in its first position to, on the one hand, grip the free end of the first end portion 11 and, on the other hand, guide the second end portion 12 extending between the article 9 and the film delivering carriage 2 as shown for example in FIG. 3. Preferably, the controllable guides also comprise two groove-shaped stops 16 and 27 movable between a first position where the stops are distal from each other as shown in FIG. 5 and a second position where the stops 16 and 27 are adjacent as shown in FIG. 7 to guide the end portions 11 and 12 extending between jaws 57 and 56 and the article 9 as shown in FIGS. 3 and 7, thereby defining the predetermined path between the jaws 57 and 56 and the stops 16 and 27. The groove-shaped stops 16 and 27 are mounted on a conveyor side 6 as shown in FIG. 1.

The apparatus also comprises first controllable nippers for nipping the first end portion at a point of the predetermined path, and second controllable nippers for nipping the second end portion at a second point of the predetermined path. Preferably, the first and second nippers are made of an assembly. The assembly comprises first and second jaws. The first jaw is a cylindrical element made of a tapered sleeve 66. The second jaw is a finger 69 movable between a first position where an end thereof operatively rests against the tapered sleeve 66 as shown for example in FIGS. 12 and 13 and a second position where the end thereof is away from the tapered sleeve 66 as shown for example in FIG. 8.

The assembly also comprises moving means for moving the finger 69 between its first and second positions. The moving means comprise first and second cooperating members. The first member is a main table 71 having a cavity with a peripheral wall. The second member is at least partially mounted within the peripheral wall of the cavity and rotatable thereabout. The second member is a shouldered sleeve 65 having a guiding groove for guiding the finger 69 along a radial direction with respect to the tapered sleeve 66. The shouldered sleeve 65 includes a pin connected to the finger 69, a roller 70 connected to the pin and a resilient element for urging the finger 69 towards its second position. The finger 69 is pushed away from its second position towards its first position against the resilient member by a rotational movement of the shouldered sleeve 65 with respect to the main table 71 upon a pressure exerted by the peripheral wall on the finger 69 via the pin and the roller 70.

The apparatus according to the first preferred embodiment also comprises third controllable nippers for nipping the second end portion at a third point of the predetermined path. Preferably, these third nippers are embodied by the gripper which is made of the jaws 57 and 56.

The apparatus according to the first preferred embodiment also comprises a controllable cutter for cutting the second end portion 12 between the second and third points of the predetermined path to obtain a free end thereof. Preferably, the controllable cutter is a heated wire cutter. An actuator 62 is connected to the controllable cutter for moving the cut wire 59 of the cutter between a first position where the cut wire 59 is in position for cutting the second end portion 12 and a second position where the cut wire 59 is in a position remote from the second end portion. The cut wire 59 is a heated cut wire. Heat wire is a well known technology.

Figure 9:
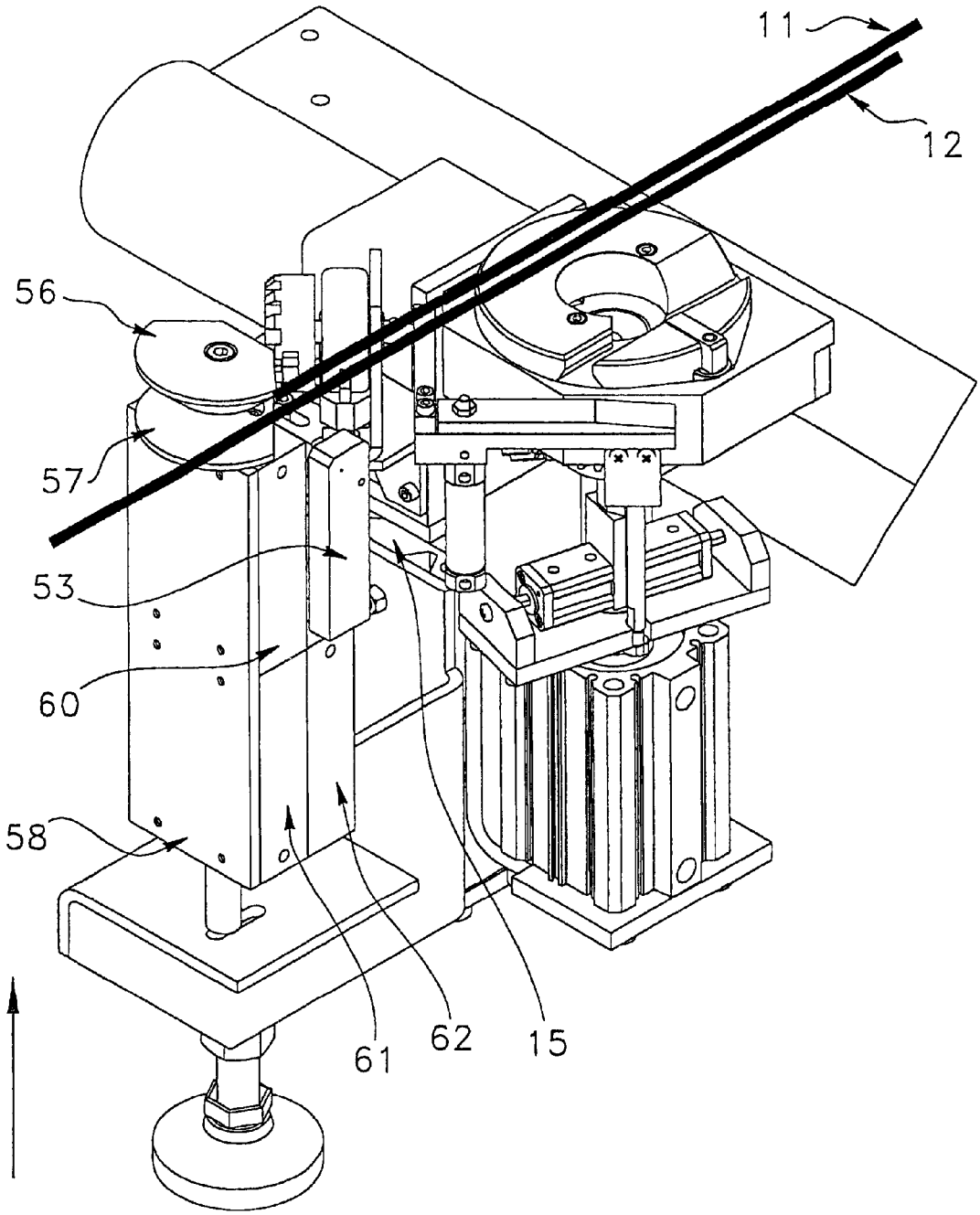
FIG. 9 is a perspective view of the element shown in FIG. 8 in an operating position, in relation with the rope-shaped end portions of flexible material.
Figure 10:
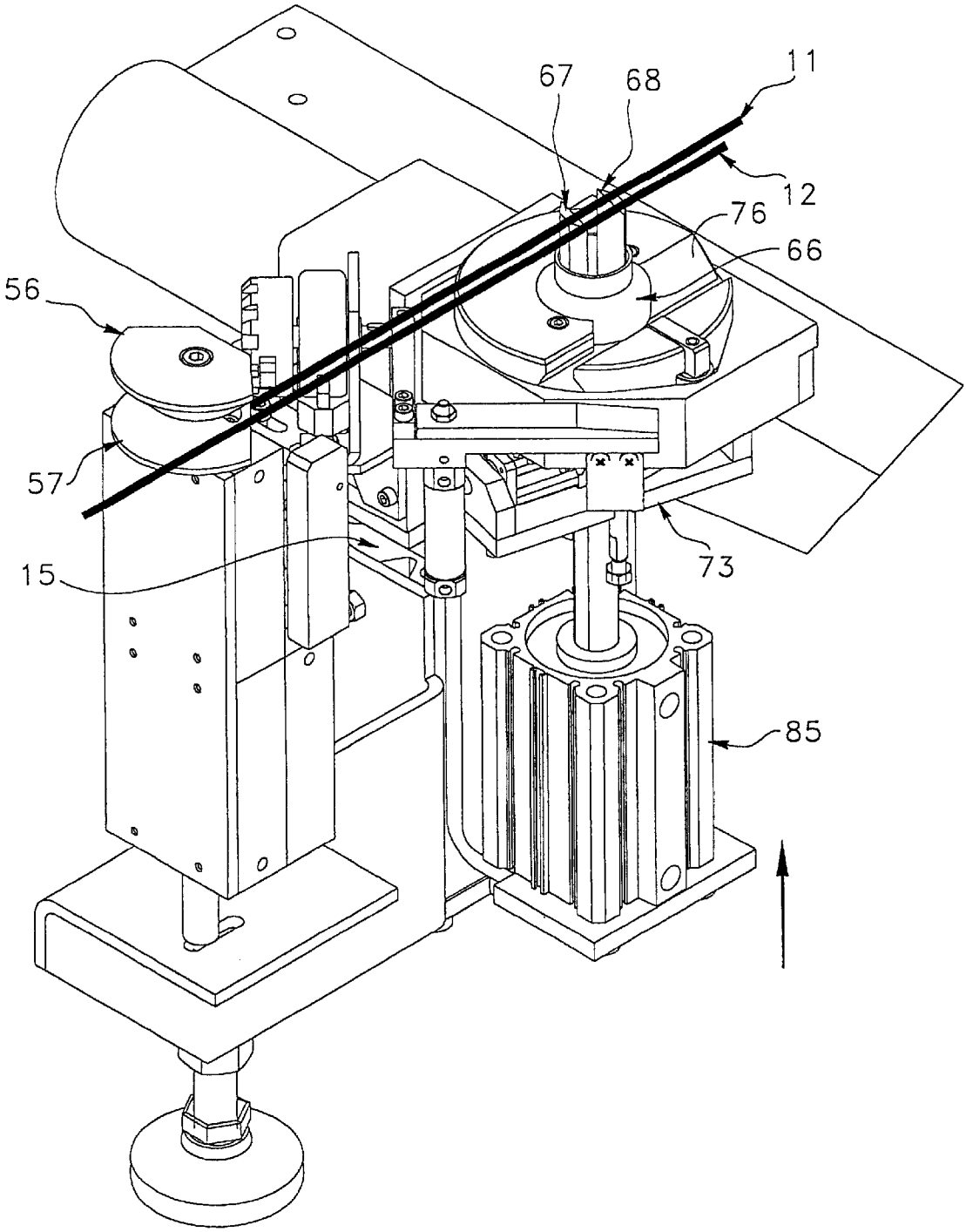
FIG. 10 is a perspective view of the element shown in FIG. 9 in a different operating position.

The shouldered sleeve 65 and the main table 71 are provided with a central opening as shown for example in FIG. 9. The tapered sleeve is mounted within the central opening of the shouldered sleeve 65 and the main table 71. The tapered sleeve 66 further comprise an actuator 85 for moving the tapered sleeve 66 between a first position where the tapered sleeve 66 projects from the central opening in position for cooperating with the finger 69 and a second position where the tapered sleeve 66 is retracted from the central opening as shown for example in FIGS. 9 and 10.

Further more, the shouldered sleeve 65 has an upper surface provided with a straight off center groove that crosses said upper surface from one side thereof to the other via a peripheral portion of the central opening. The off-center groove is sized for receiving the rope-shaped end portions. The off-center groove is provided, along a portion thereof extending from the central opening to the periphery of the upper surface, with a bias shoulder 76. The assembly further comprises an actuator 15 for moving the shouldered sleeve 65, main table 71 and the tapered sleeve 66 between a first position where the off-center groove of the shouldered sleeve 65 is lower than pre-determined path of the rope-shaped end 11 and 12 and a second position where the off-center groove of the shouldered sleeve 65 is adjacent to the pre-determined path of the rope-shaped end 11 and 12 as shown for example in FIGS. 10 and 11.

Figure 16:
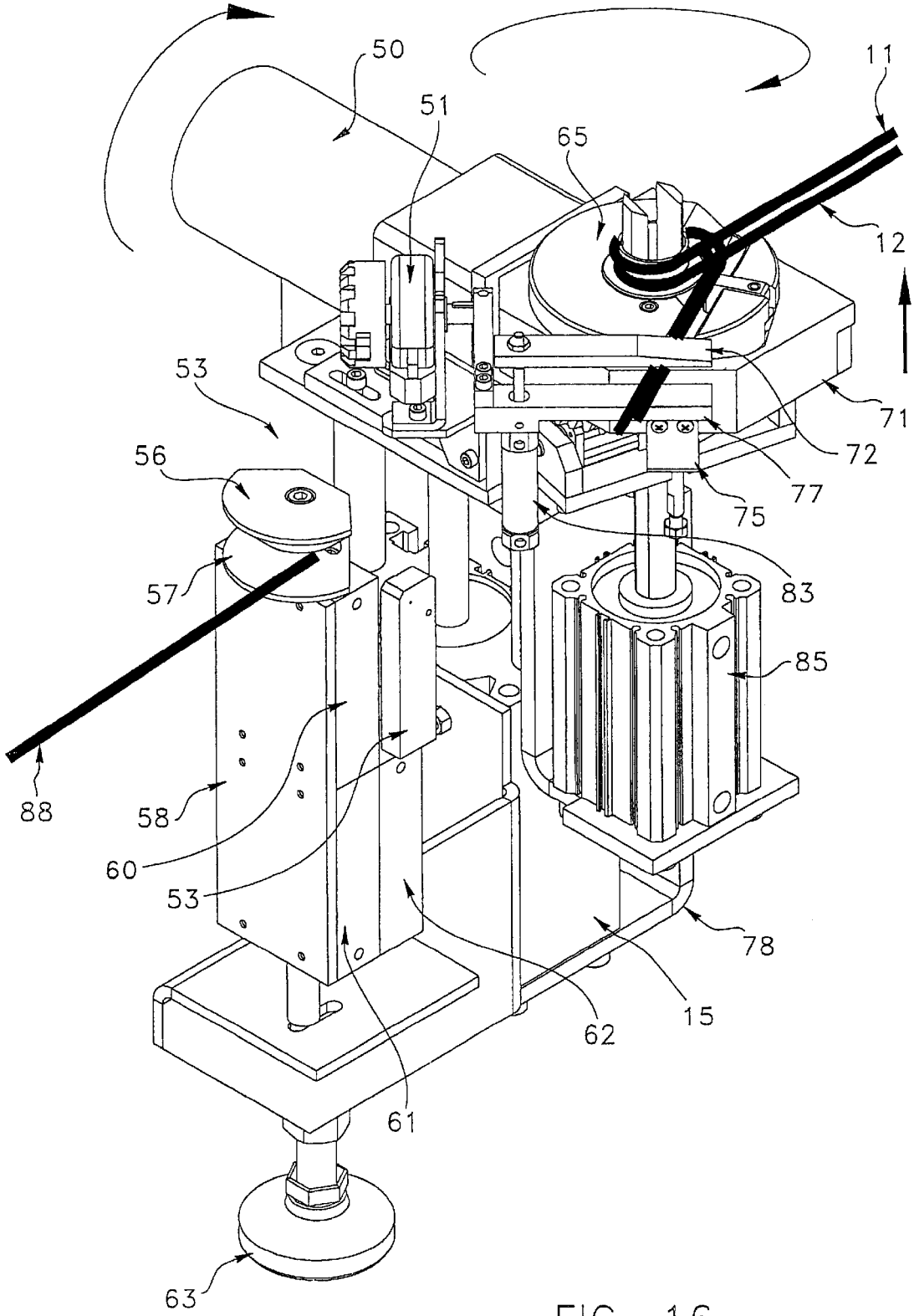
FIG. 16 is a perspective view of the element shown in FIGS. 9 to 15 in a different operating position.

The apparatus according to the first preferred embodiment also comprises controllable moving means for moving the rope-shaped end portions to obtain a loop. Preferably, these first moving means are embodied by the assembly. The loop is obtained by rotating the shouldered sleeve 65 with respect to tapered sleeve 66 when the shouldered sleeve 65 and the main table 71 are in their first position as shown in FIG. 16 thereby looping the free ends around the tapered sleeve 66. Preferably, the tapered sleeve 66 is hollow with an open end.

Figure 18:
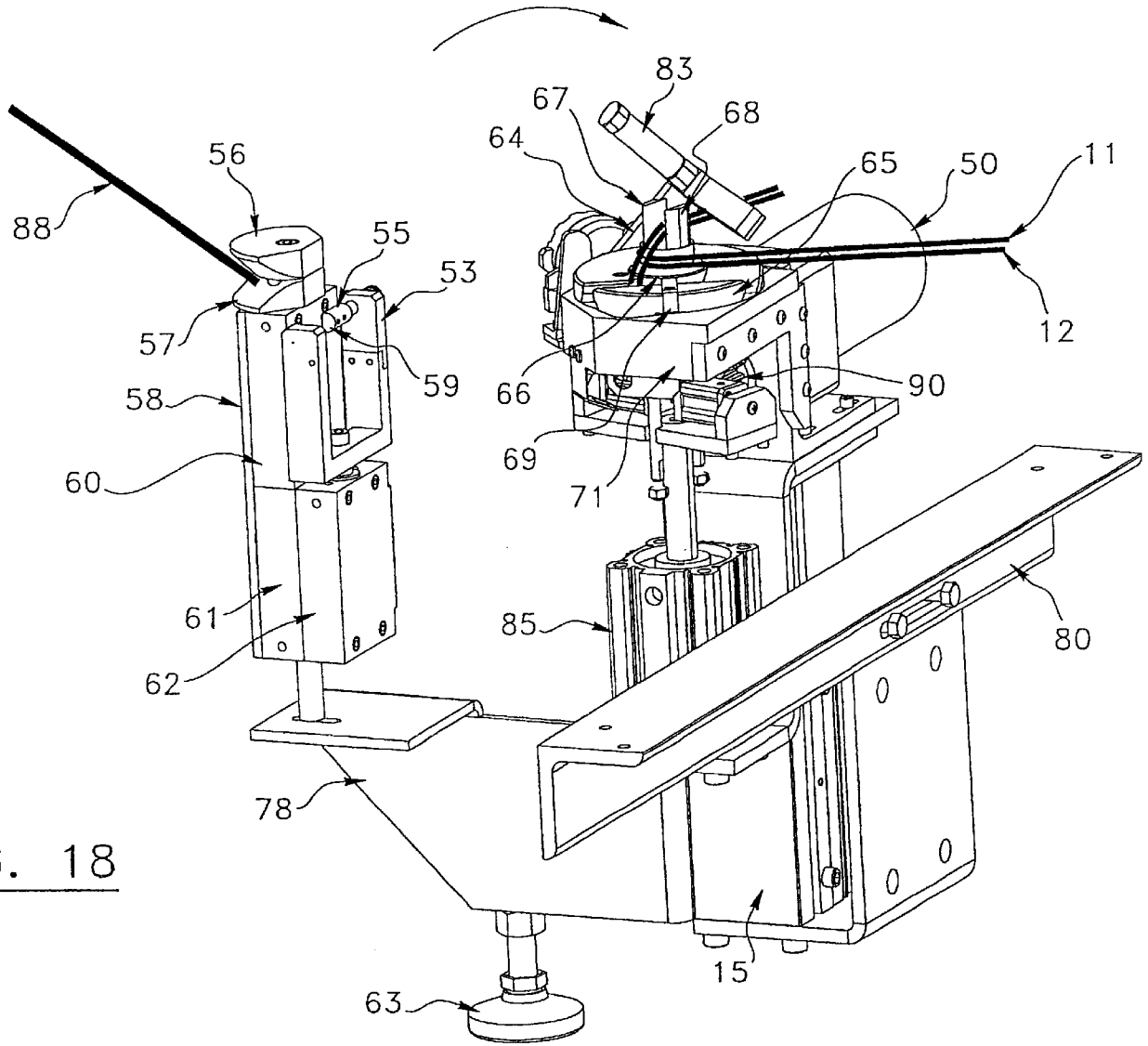
FIG. 18 is a perspective view of the element shown in FIGS. 9 to 17 in a different operating position.
Figure 19:
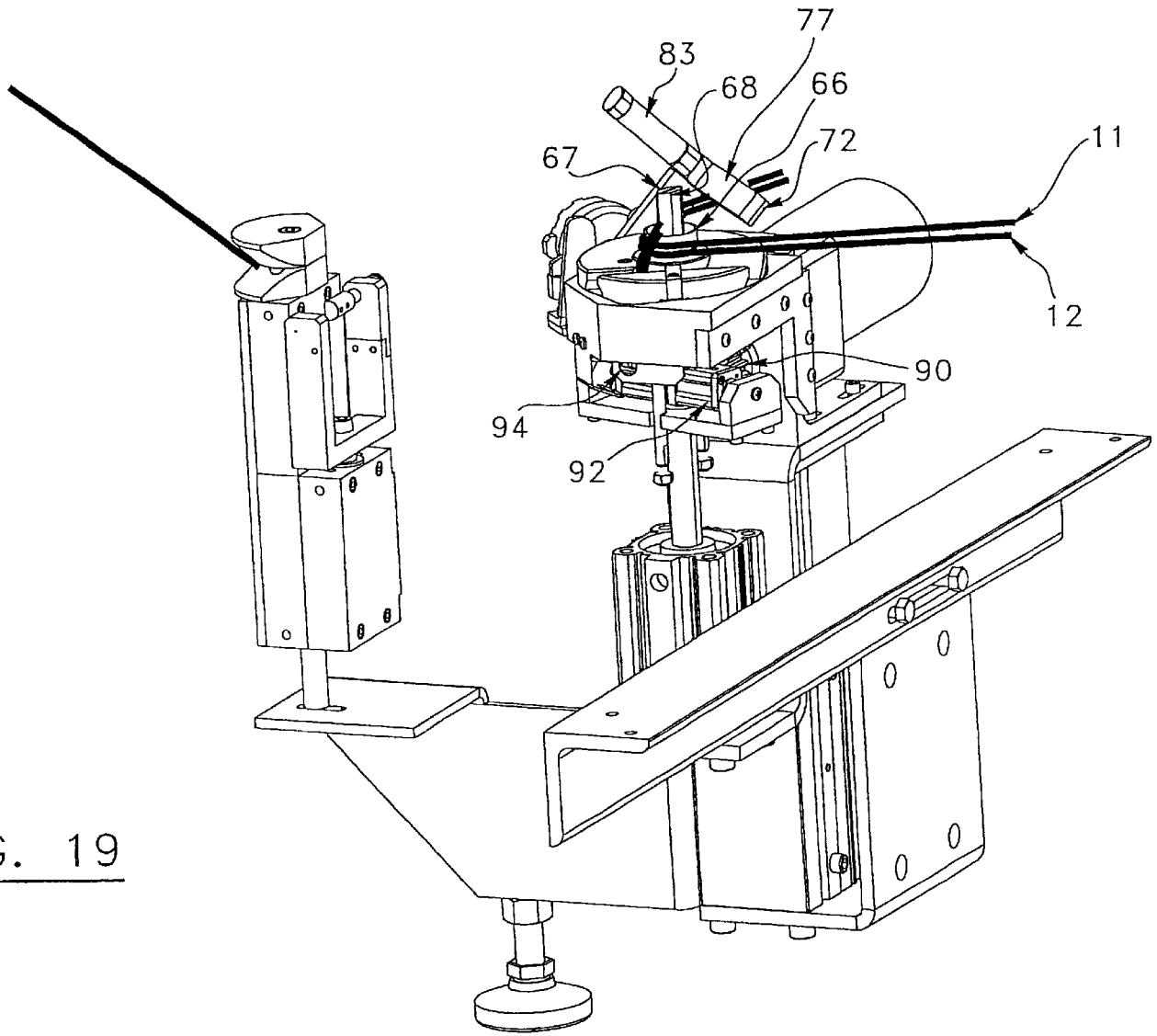
FIG. 19 is a perspective view of the element shown in FIGS. 9 to 18 in a different operating position.

The apparatus according to the first preferred embodiment also comprises moving means for moving the free ends of the end portions 11 and 12 into the loop to form and tighten the knot. Preferably, these moving means comprise pair of jaws 72 and 71 movable between a first position where it is in position to grip the free ends of the rope-shaped end portions 11 and 12 once the looping thereof around the tapered sleeve 66 has been performed to a second position where a part of the free ends faces the open end of the tapered sleeve 66 as shown for example in FIG. 18. Preferably, these moving means also comprise pair of jaws 67 and 68. The jaw 68 is movable between a first position where the jaws 67 and 68 are in position to receive the free ends 11 and 12 facing the open end of the tapered sleeve 66 and a second position where the free end are griped with jaws 67 and 68 as shown in FIGS. 18 and 19. The jaws 67 and 68 further comprise an actuator 85 for moving the jaws 67 and 68 to a first position where the jaws project from the central opening of the tapered sleeve 66 and a second position where the jaws are retracted from the central opening of the tapered sleeve 66 in order to insert the free ends into the loop as shown for example in FIGS. 19, 20 and 21.

Once form, the knot is tightened using the movement of the shouldered sleeve 65, the main table 71 and the tapered sleeve 66 previously described.

Figures 12, 13:
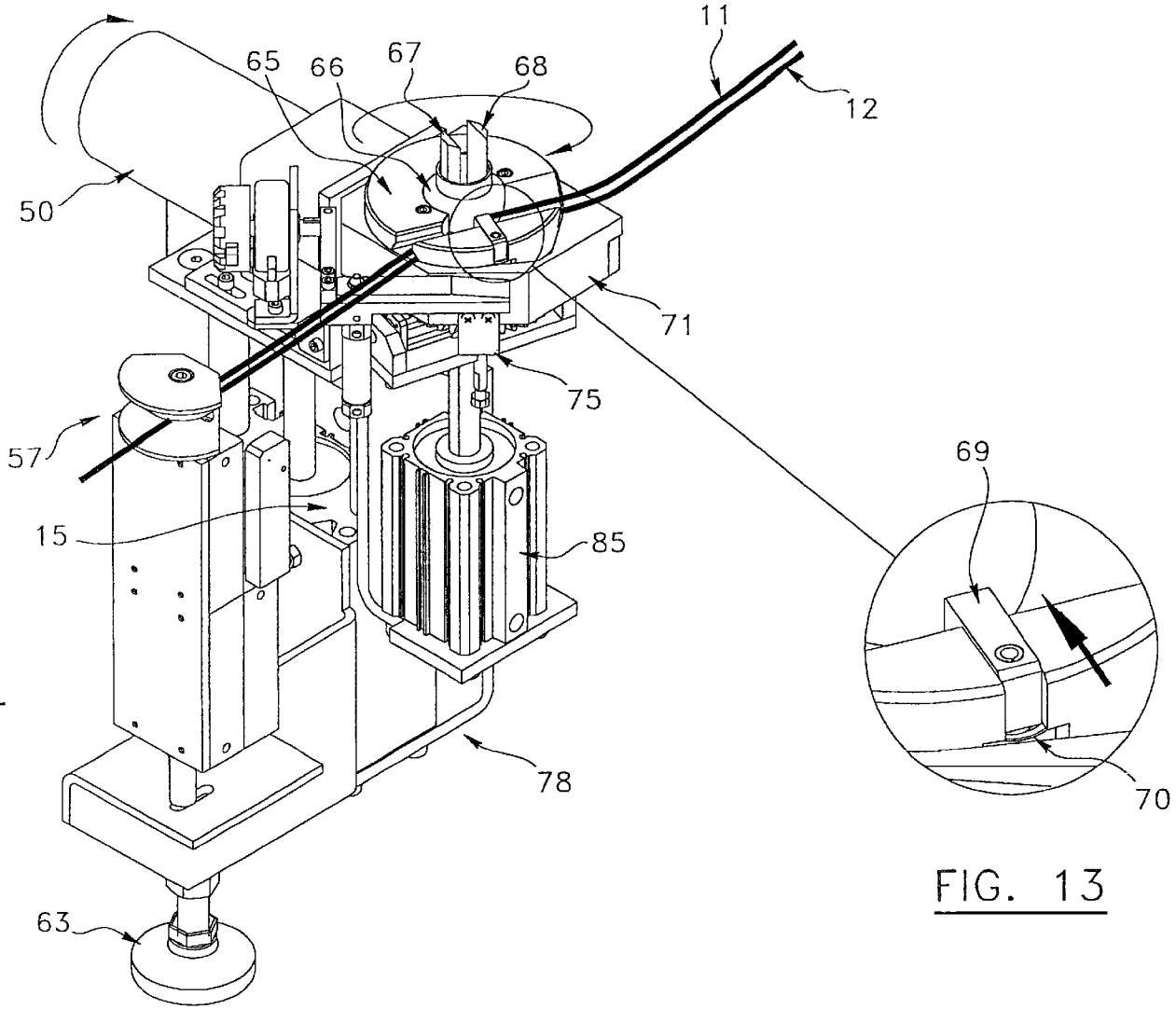
FIG. 12 is a perspective view of the element shown in FIGS. 9 to 11 in a different operating position.
FIG. 13 is an enlarged view of a detail of FIG. 12.
Figure 14:
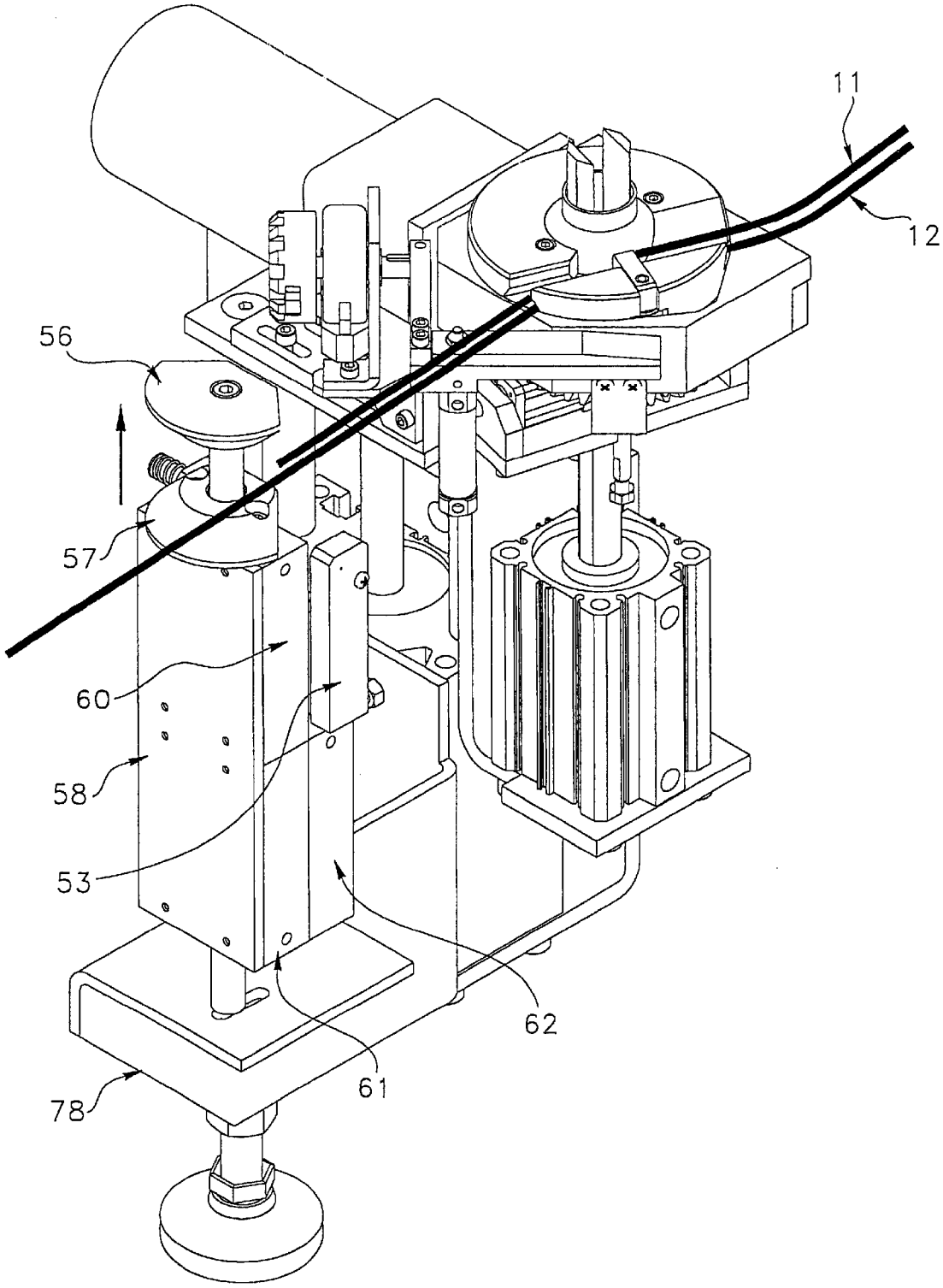
FIG. 14 is a perspective view of the element shown in FIGS. 9 to 13 in a different operating position.
Figure 15:
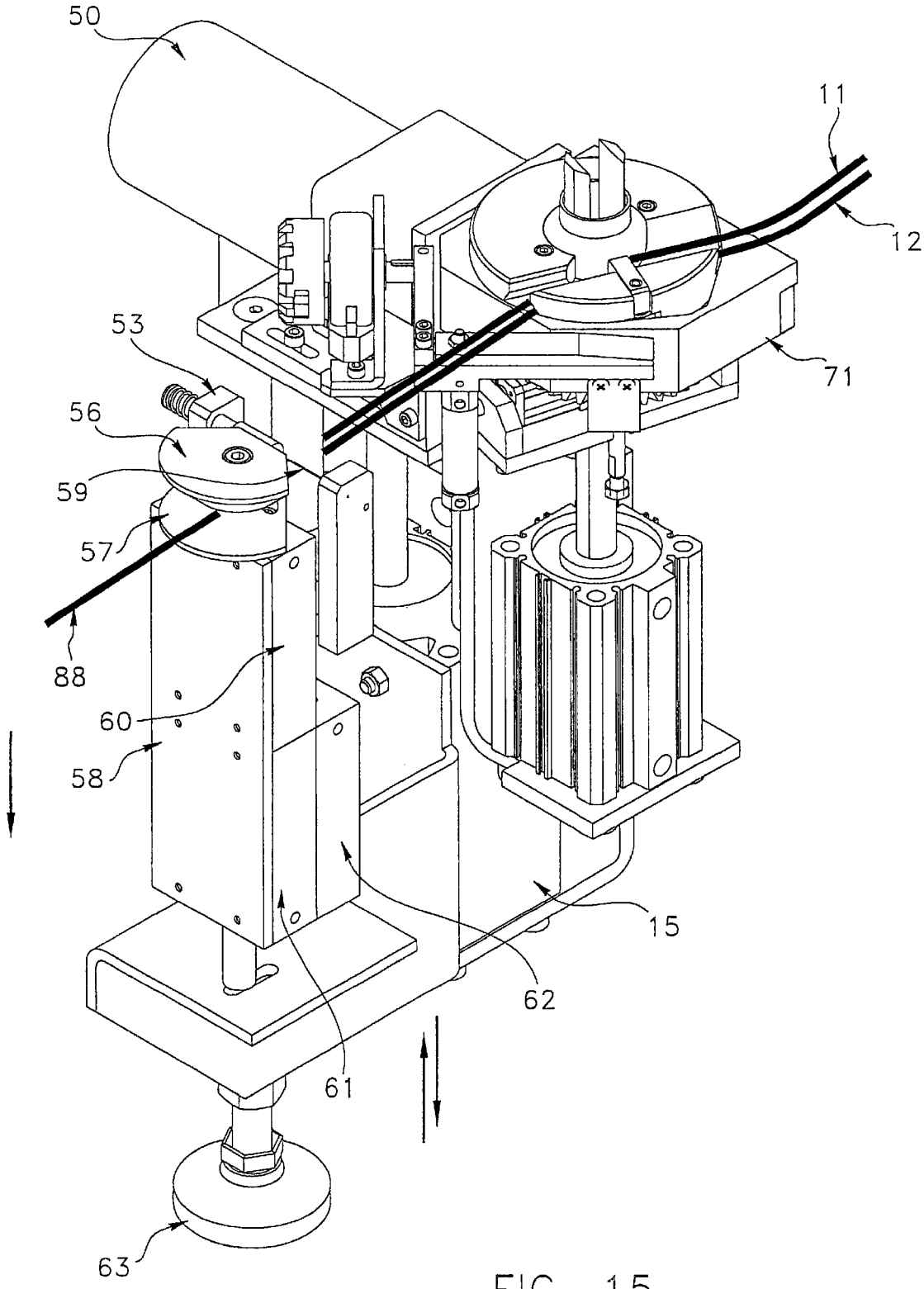
FIG. 15 is a perspective view of the element shown in FIGS. 9 to 14 in a different operating position.

We will now describe a method for making a knot with the first and second rope-shaped end portions 11 and 12 of flexible material wrapped around the article 9 in reference to FIGS. 3 and 12 to 21. The method comprises the steps of (a) guiding the end portions 11 and 12 along a predetermined path as shown in FIG. 3; (b) (i) nipping the first end portion 11 at a first point of the predetermined path as shown in FIGS. 12 and 13, (ii) nipping the second end portion 12 at a second point of the predetermined path as shown in FIGS. 12 and 13, and (iii) nipping the second end portion 12 at a third point of the predetermined path as shown in FIGS. 14 and 15; (c) cutting the second end portion 12 between the second and third points to obtain a free end thereof as shown in FIG. 15; (d) moving the end portions 11 and 12 to obtain a loop as shown in FIG. 16; (e) releasing the first end portion 11 from the guiding of step (a) to obtain a free end thereof as shown in FIG. 14; and (f) inserting the free ends into the loop to form and tighten the knot as shown in FIGS. 17 to 21.

Figure 17:
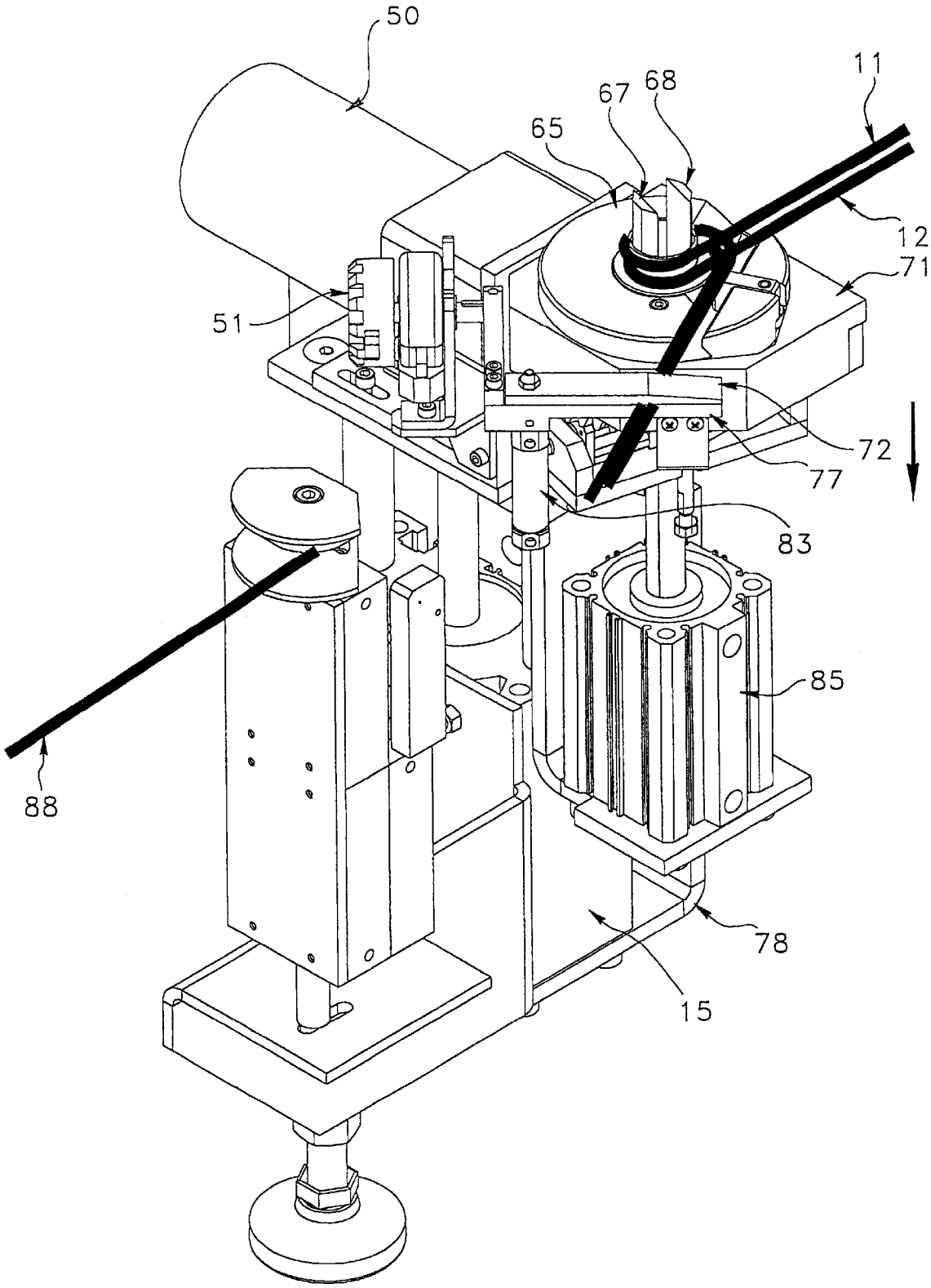
FIG. 17 is a perspective view of the element shown in FIGS. 9 to 16 in a different operating position.
Figure 20:
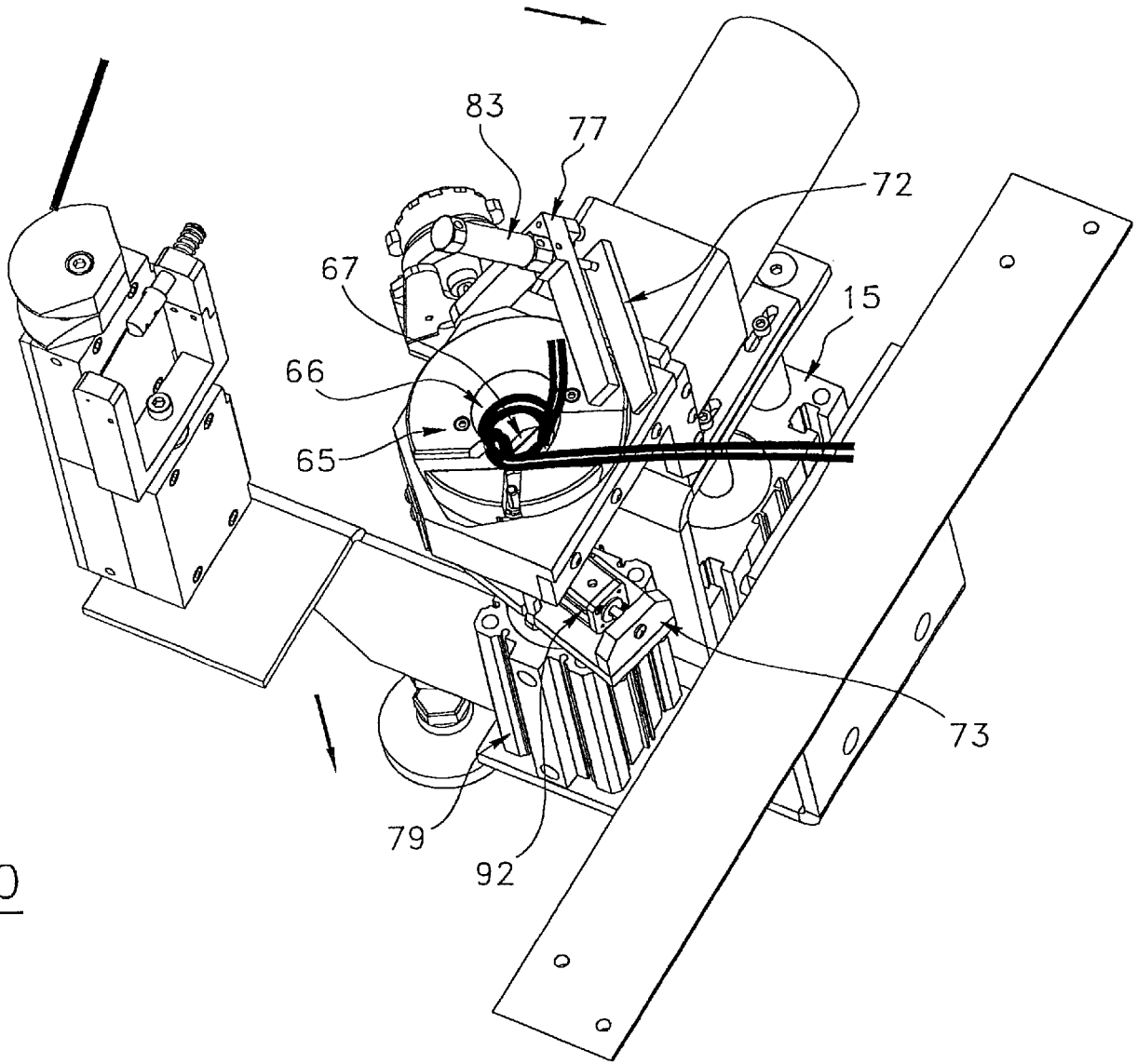
FIG. 20 is a perspective view of the element shown in FIGS. 9 to 19 in a different operating position.
Figure 21:
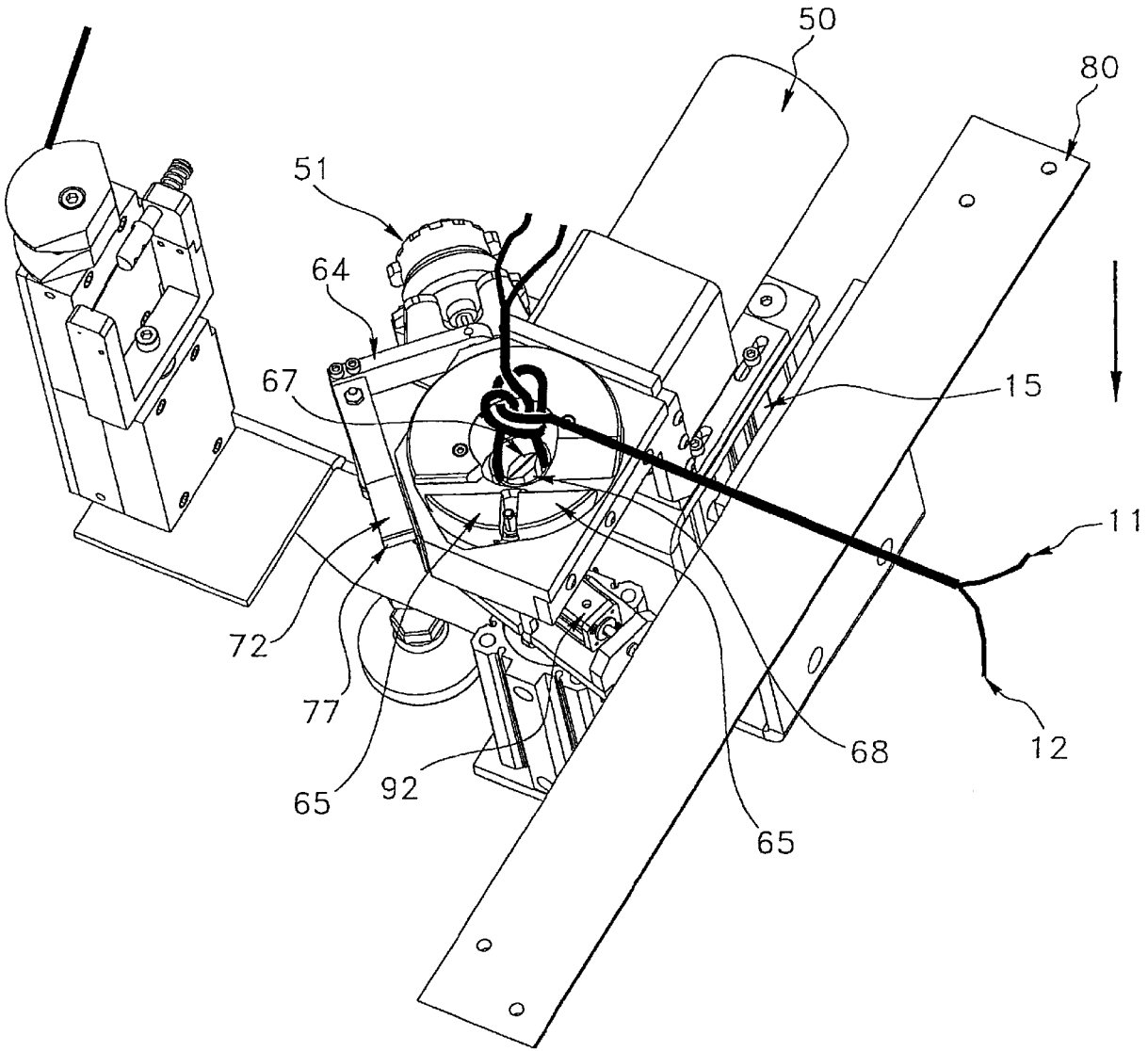
FIG. 21 is a perspective view of the element shown in FIGS. 9 to 20 in a different operating position.

Preferably, according to the first preferred embodiment, step (e) is performed after sub-steps (i) and (ii) and before sub-steps (iii). Also preferably, step (d) is performed after step (c) and comprises steps of rotating the free ends around a hollow shaft having an end opening to obtain the loop as shown in FIG. 16. Step (f) comprises (iv) gripping and moving the free ends to place portions thereof over the end opening as shown in FIGS. 17 and 18, and (v) gripping and inserting said portions of the free ends into the hollow shaft thereby inserting the free ends into the loop as shown in FIGS. 19 to 21. Also preferably, in step (a) the end portions are guided in parallel along the predetermined path as shown in FIG. 3. Also preferably, step (c) includes steps of heating a heat wire, and moving the heat wire transversally with respect to the second end portion 12 as shown in FIG. 15.

We will now describe with more details the operation of the first preferred embodiment. At the beginning of a wrapping procedure, the first end portion 11 of flexible material 10 is already placed within jaws 56 and 57, and the film delivering carriage 2 is in roping configuration. The wrapping cycle is started by rotating the film delivering carriage 2 around the article 9 and after the first quarter of revolution of the wrapping arm 7, the film delivering carriage 2 is brought back to full web configuration to fully wrap the article with a web by moving the carriage 2 according to a conventional up and down spiral motion. During its last half revolution, the film delivering carriage 2 is once more brought into rope configuration to form the second rope-shaped end portion 12. The arm 7 is then stopped at its home position.

The two ropes are guided by activating the guide actuator 22. The clamp actuator 61 is also activated in order to raise the clamp assembly. The arm 7 is rotated backward to position the rope 12 in relation to the clamp jaws 56 and 57

Figure 11:
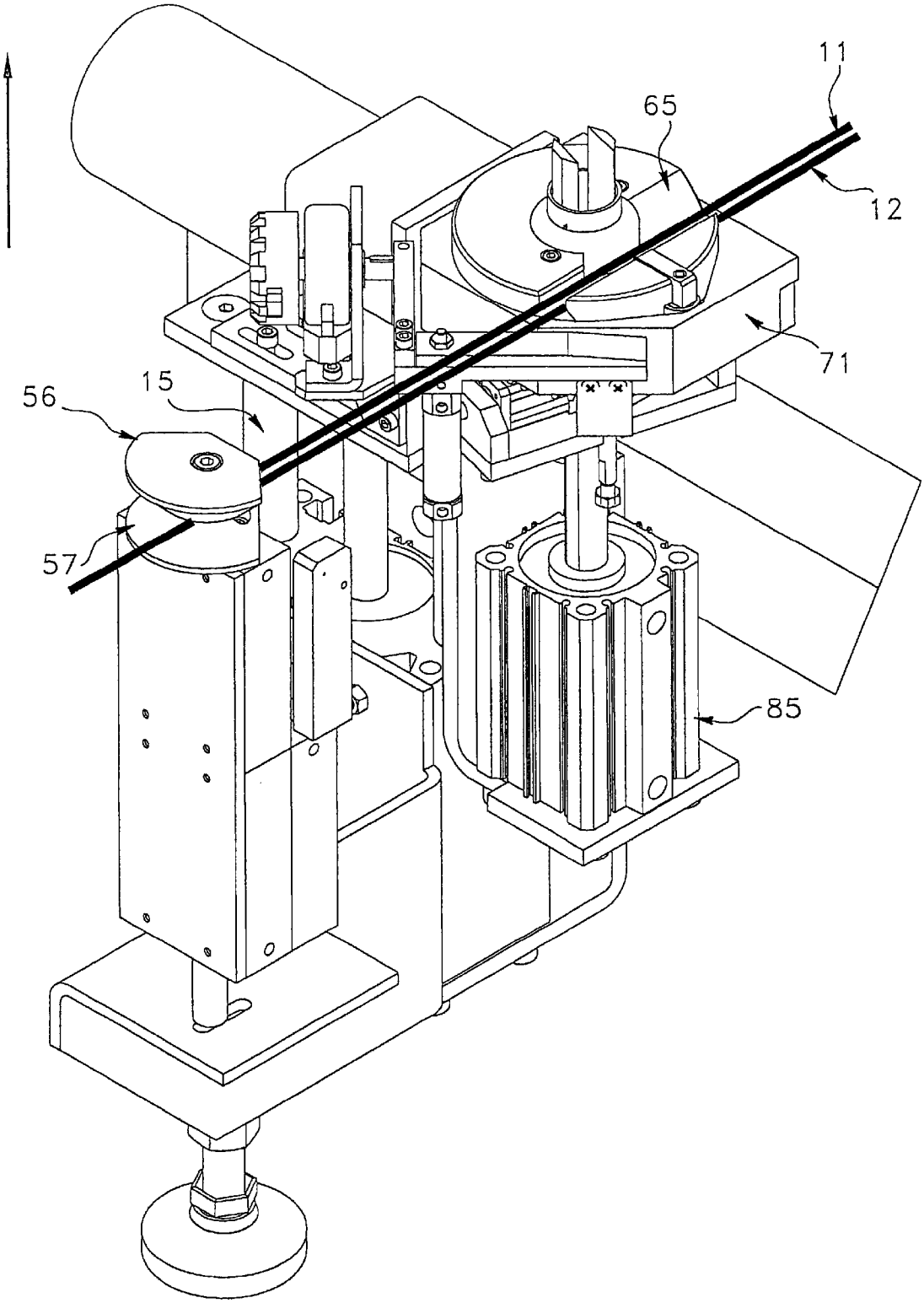
FIG. 11 is a perspective view of the element shown in FIGS. 9 and 10 in a different operating position.

Then the shouldered sleeve 65 with the main table 71 are brought up to position the two end portions 11 and 12 between the tapered sleeve 66 and the finger 69, within the groove of the shouldered sleeve 65 as shown in FIG. 11. The shouldered sleeve 65 is then rotated with a motor 50 and gear 90 until the end portions 11 and 12 are locked between the tapered sleeve 66 and the finger 69 as shown in FIGS. 12 and 13. This operation is controlled by counting a predetermined number of teeth on the gear 90 which is a pinion bevel gear and by means of proximity sensor 75. The upper jaw 56 is lifted by means of actuator 60 to release the first end portion 11 as shown in FIG. 14. The second end portion 12 placed between the jaws 56 and 57 is grasped when the jaw 56 is moved down as shown in FIG. 15.

The cut wire 59 is heated and the heat wire actuator 62 moves the cut wire 59 up to cut the second end portion 12. The actuator 62 then brings back the cut wire 59 to its down position. Another end portion 88 is then obtained. This end portion 88 extends between the jaws 57 and 56 to the film delivering carriage 2 and will be used as the first end portion of the next wrapping cycle.

Figure 22:
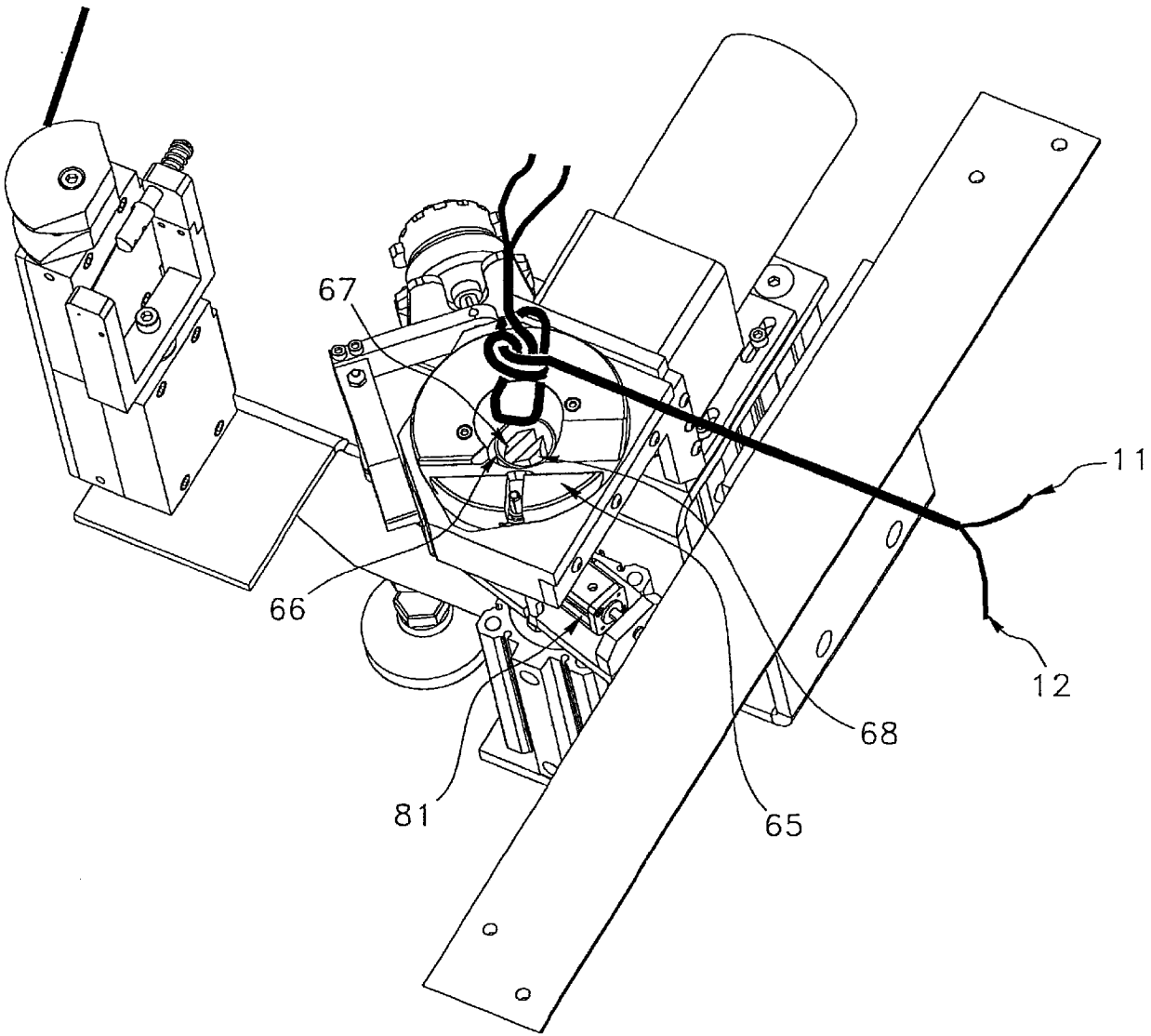
FIG. 22 is a perspective view of the element shown in FIGS. 9 to 21 in a different operating position.

The shouldered sleeve 65 is then rotated according to a predetermined number of teeth with the motor 50 and gear 90 so as to bring the end portions 11 and 12 in position to be gripped with the jaws 72 and 77 which are opened by means of actuator 83, as shown in FIG. 16. Once in place, the actuator 83 closes the jaws 72 onto 77 to hold the end portions 11 and 12 as shown in FIG. 17. The rotary actuator 51 is then activated to rotate the jaws 72 and 77 and bring the end portion 11 and 12 between the jaws 67 and 68, as shown in FIG. 18. The jaws 67 and 68 are then closed on the end portions 11 and 12 by means of the actuator 92, as shown in FIG. 19. The jaws 72 and 77 are then opened by means of the actuator 83 to free the end portions 11 and 12. The end portions 11 and 12 are then drawn downwardly by means of the actuator 85 to form the knot as shown in FIG. 20. The actuator 15 is activated to lower the shouldered sleeve 65 and the main table 71 in order to tighten the knot as shown in FIG. 21.The rotary actuator 51 is brought back to its home position. The jaws 67 and 68 are then opened by means of actuator 81 as shown in FIG. 22. The stops 16 and 27 are moved back to their standby position as shown in FIG. 5 by means of actuator 22. Then the knot rests on the side of the wrapped article 9.

Figure 23:
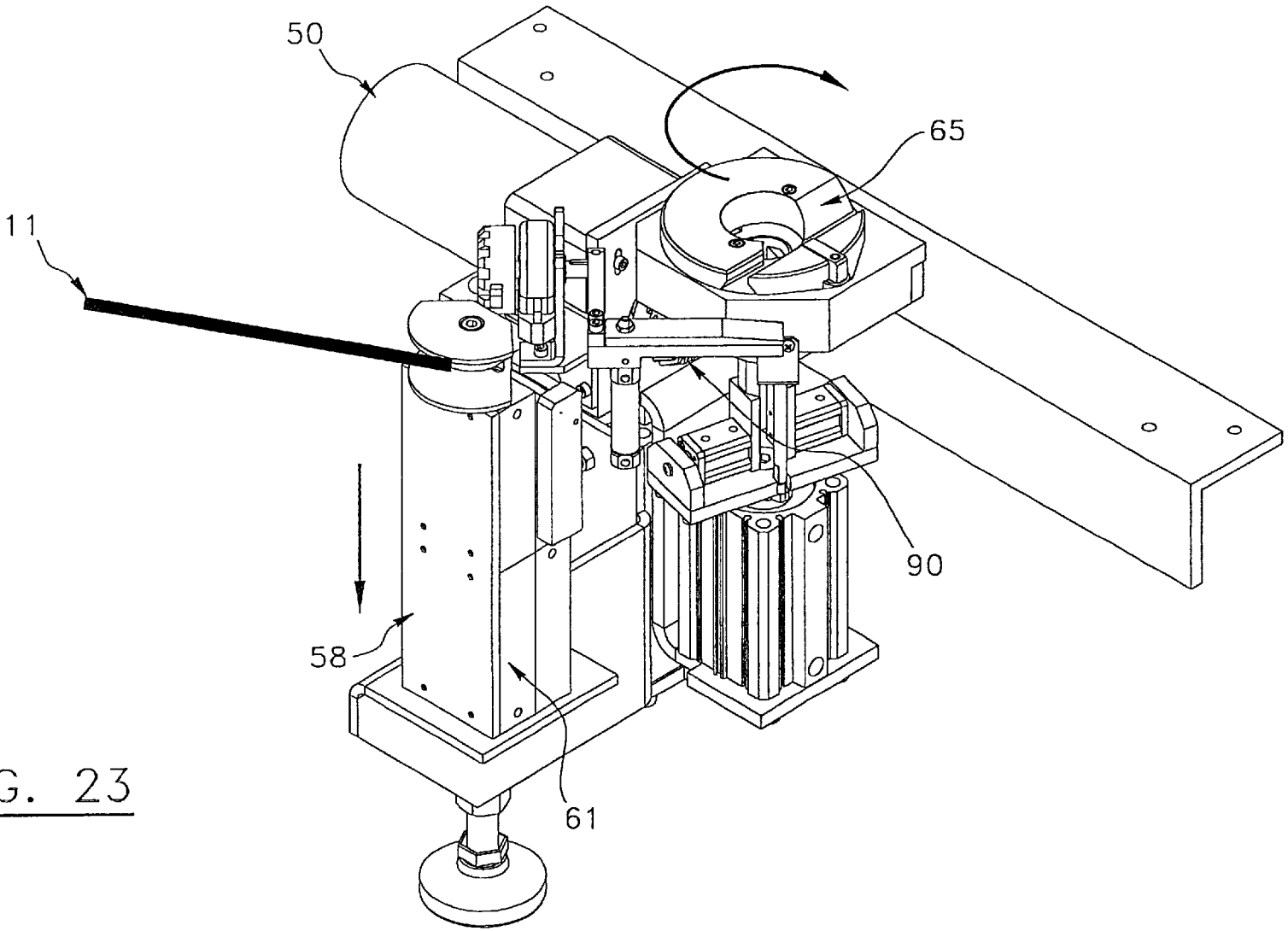
FIG. 23 is a perspective view of the element shown in FIGS. 9 to 22 in a different operating position.

The shouldered sleeve 65 is rotated back to its home position as shown in FIG. 23 by means of motor 50 and the home proximity sensor 94 shown in FIG. 19. The clamp actuator 61 is retracted to home position as shown in FIG. 23. The product is conveyed out of the wrapping area by activating conveyor 6. The next wrapping cycle is ready to start.

Figure 24:
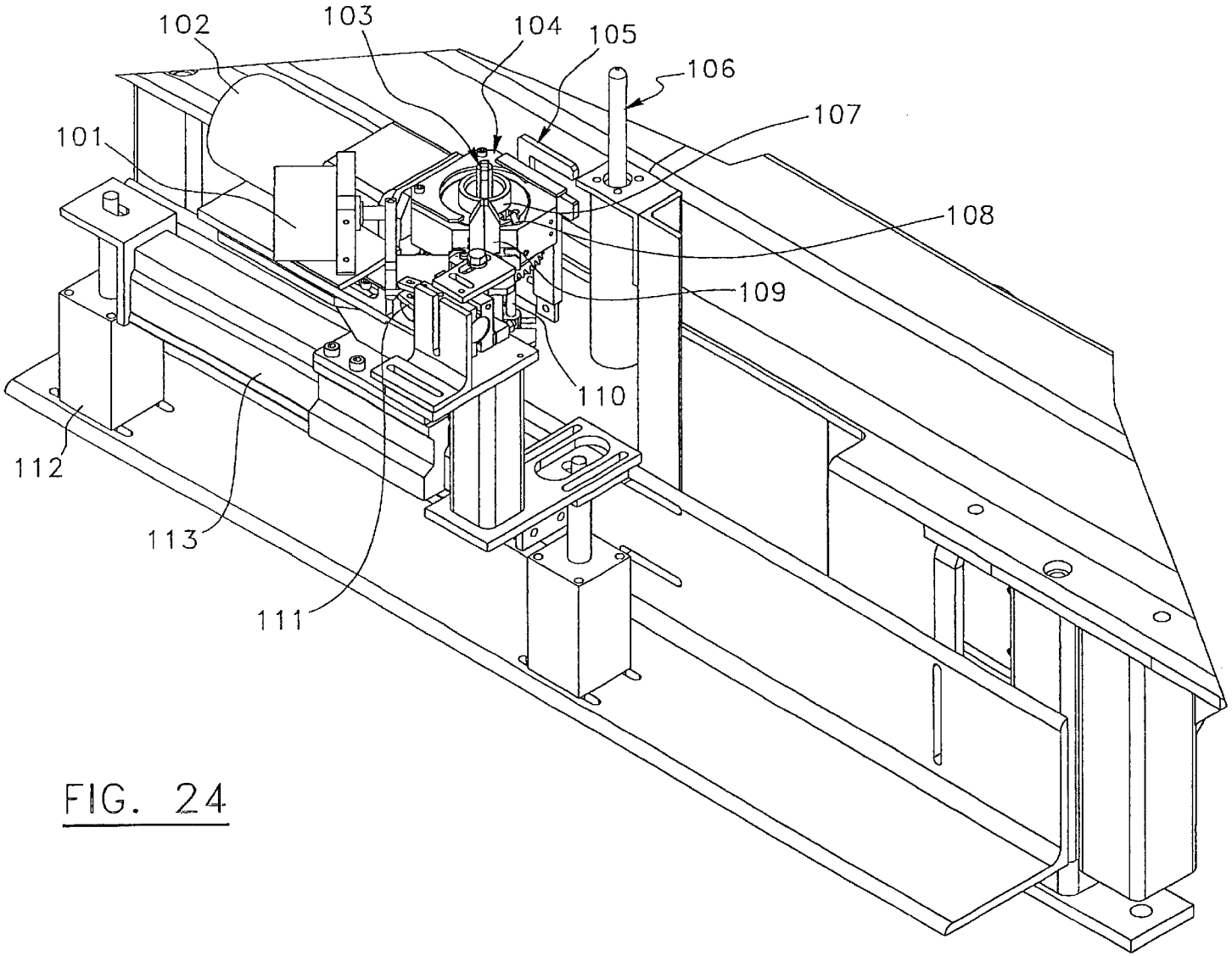
FIG. 24 is a perspective view of a second preferred embodiment of the present invention.

Referring now to FIG. 24, there is shown a second preferred embodiment of the invention. A first tail of the film is placed in the initial clamp 111. The wrapping cycle is started with the film delivering carriage (not shown) in roping configuration. After the first half revolution of the delivering carriage (not shown), it is brought back to full web configuration to fully wrap the article. During the last half revolution of the delivering carriage around the article, the film delivering carriage is brought back into rope configuration to make a second tail.

A gathering mechanism 105, 106 and 113 gathers the two tails and clamps them at a predetermined position between the knotter head of the apparatus and the wrapped article. The knotter head is brought up by means of actuator 112 to position the two tails between a knotting sleeve 107 and the cam clamp 108 within the guide 104. The knotting sleeve 107 is then rotated with the motor and gear 102 until the two tails are locked against the knotting sleeve 107 and the cam clamp 108 and then stopped.

The first tail which is still in the initial clamp 111, is released from it. The second tail, which extends from the knotting sleeve 107 to the film delivering carriage is then clamped by means of initial clamp 111. The last tail is then cut between the initial clamp 111 and the knotting sleeve 107. The initial clamp 111 now holds the first tail of the next cycle. The knotting sleeve 107 performs a full revolution under the control of the motor and gear 102 to wrap a portion of the tails around the knotting sleeve 107. When the revolution is completed, the two ends of the tails are gripped by means of tail gripper 109. Once gripped, the rotary actuator 101 brings the tail end portions over the wrapped knotting sleeve 107 into the jaws 103 of the tail puller 110. Once the tail ends are in the tail puller jaws, the tail puller 110 is retracting to pull the two tail ends into the core of the knotting sleeve 107. The knotting sleeve 107 is then pulled downward in order to release the portion wrapped around it. The gathering clamps 105, 106 and 113 release the rope portions. The knot is now formed between the article and the tail puller. The tail puller releases the two tail ends and the knot is freed. All the mechanism then returns to the initial position and the next cycle is ready to start.

Figure 26:
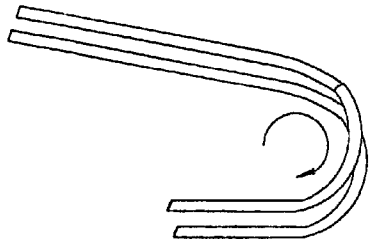
FIG. 26 is a schematic representation of a second step of the method initiated in FIG. 25.
Figure 28:
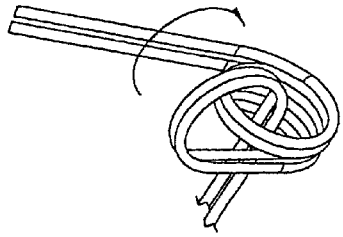
FIG. 28 is a schematic representation of a fourth step of the method initiated in FIGS. 25 to 27.
Figure 25:
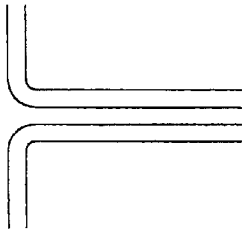
FIG. 25 is a schematic representation of a first step of a method according to the first and second preferred embodiments.
Figure 27:
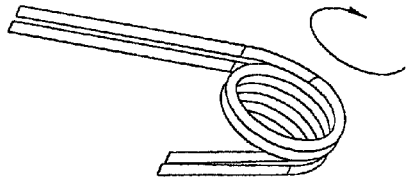
FIG. 27 is a schematic representation of a third step of the method initiated in FIGS. 25 and 26.
Figure 29:
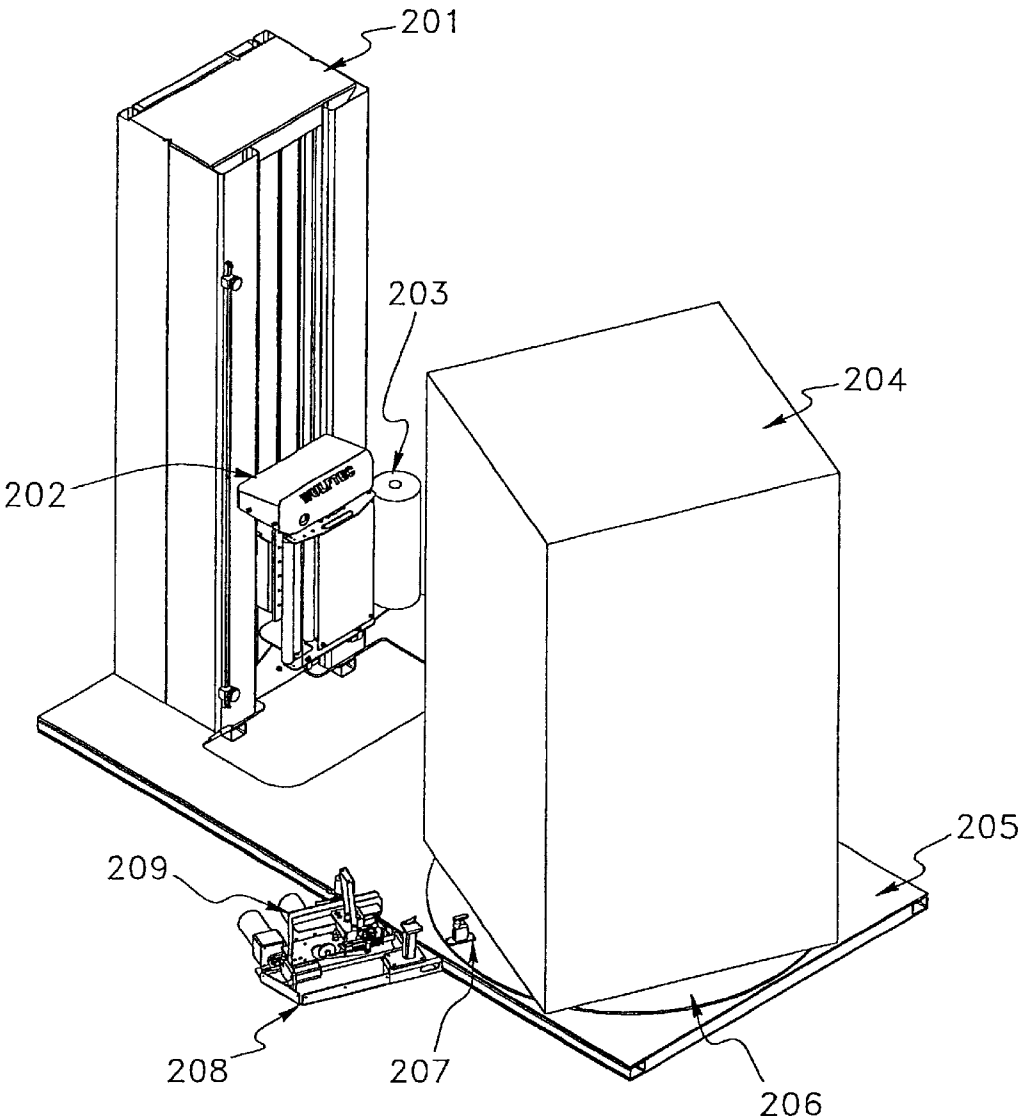
FIG. 29 is a perspective view of a wrapping machine provided with a third preferred embodiment of the present invention.

Referring now to FIGS. 25 and 28, there are shown the steps of the method for forming a knot by means of first preferred embodiment shown in FIGS. 1 to 23, and second embodiment shown in FIG. 24. In FIG. 25, the tails are guided along a predetermined path. Then, in FIGS. 26 and 27, a loop is formed. In FIG. 28, the free ends of the tails are pulled into the loop to form and tighten the knot.

Referring now to FIGS. 29 to 54, there is shown a third preferred embodiment of the present invention. Please find hereunder the numeral list of the components illustrated in FIGS. 29 to 48:

| | |
|---|---|
| 201 Tower | 212 Transfer arm |
| 202 Carriage | 213 Transfer arm link |
| 203 Film roll | 214 Clamp jaw trigger |
| 204 Article | 215 Clamp push arm |
| 205 Machine base | 216 Spring cage |
| 206 Rotary table | 217 Rack |
| 207 Table clamp | 218 Transfer arm base |
| 208 Knotter base | 219 Clamp jaw |
| 209 Knotter head | 220 Pinion |
| 211 Frame plate | 221 Clamp lifter arm |
| 222 Transfer arm trigger | 255 Drive sprocket |
| 223 Rotation head drive shaft | 256 Idler sprocket |
| 224 Clamp lifter cam | 257 Drive pulley |
| 225 Clamp rotation cam | 258 Idler pulley |
| 226 Trigger base | 230 Sprocket |
| 227 Linear bearing | 231 Chain |
| 228 Guide shaft | 232 Gear motor support |
| 229 Proximity sensor | 233 Forward/reverse gear motor |
| 234 Bracket | 259 Belt |
| 235 Cam rotation gear motor | 260 Rotation head guide |
| 236 Rotation head gear motor | 261 Transfer arm pinion |
| 237 Transfer clamp jaw | 262 Heat wire |
| 238 Clamp roller guide | 263 Table clamp trigger |
| 239 Clamp solenoid | 264 First rope |
| 240 Solenoid rod | 265 Last rope |
| 241 Transfer clamp | 266 Knot |
| 242 Rotation head | 311 Frame plate |
| 243 Movable jaw | 314 Clamp jaw trigger |
| 244 Rack pushpin guide | 315 Clamp push arm |
| 245 Rack pushpin | 317 Rack |
| 246 Cam drive shaft | 320 Pinion |
| 247 Movable jaw shaft | 321 Clamp lifter arm |
| 251 Heat wire holder | 324 Clamp lifter cam |
| 252 Transfer arm lever | 325 Clamp rotation cam |

-continued

| | |
|---|---|
| 253 Transfer arm cam follower | 346 Cam drive shaft |
| 254 Chain | 355 Sprocket |

Figure 30:
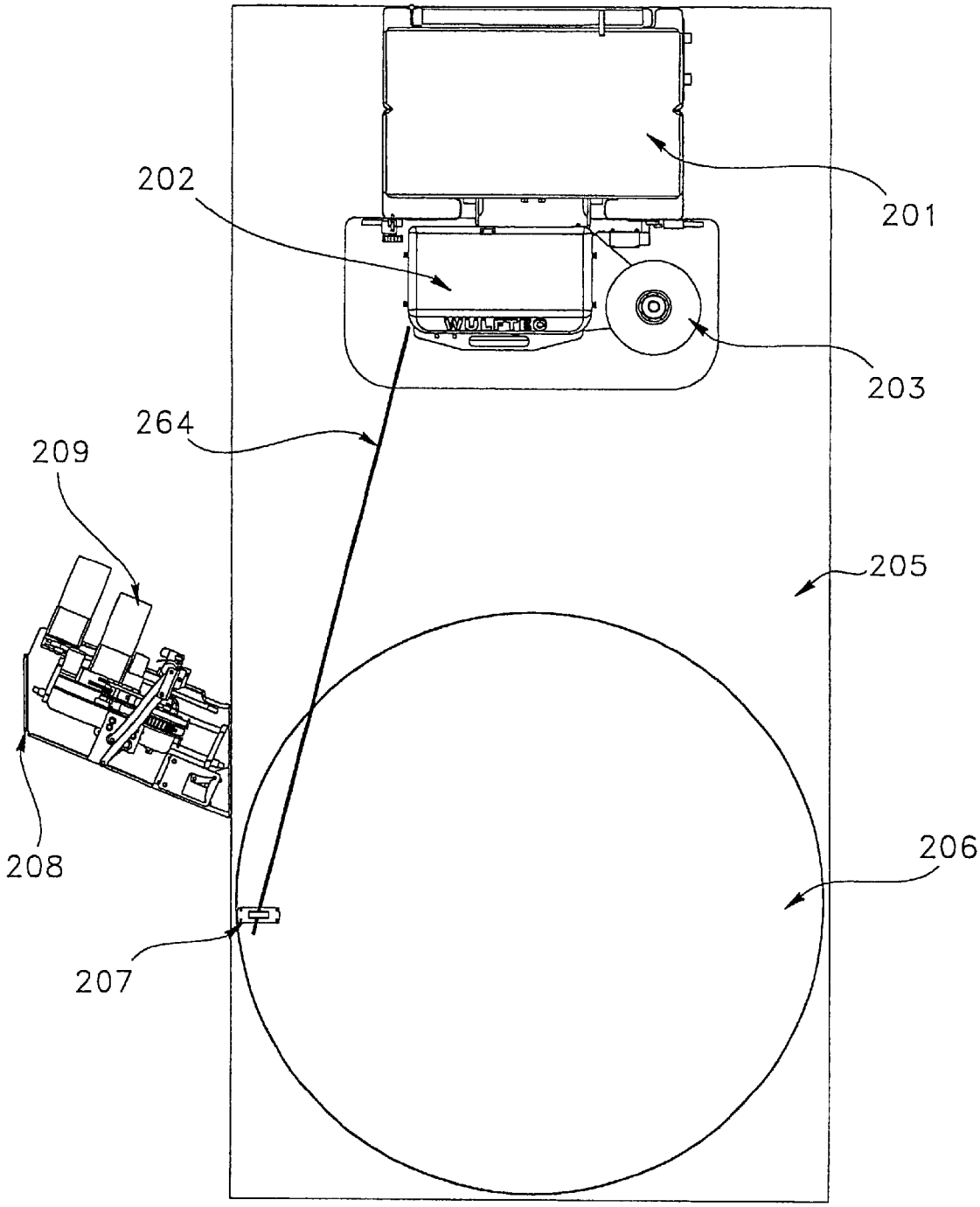
FIG. 30 is a top view of the wrapping machine with the third preferred embodiment without the article, in an operating position.
Figure 31:
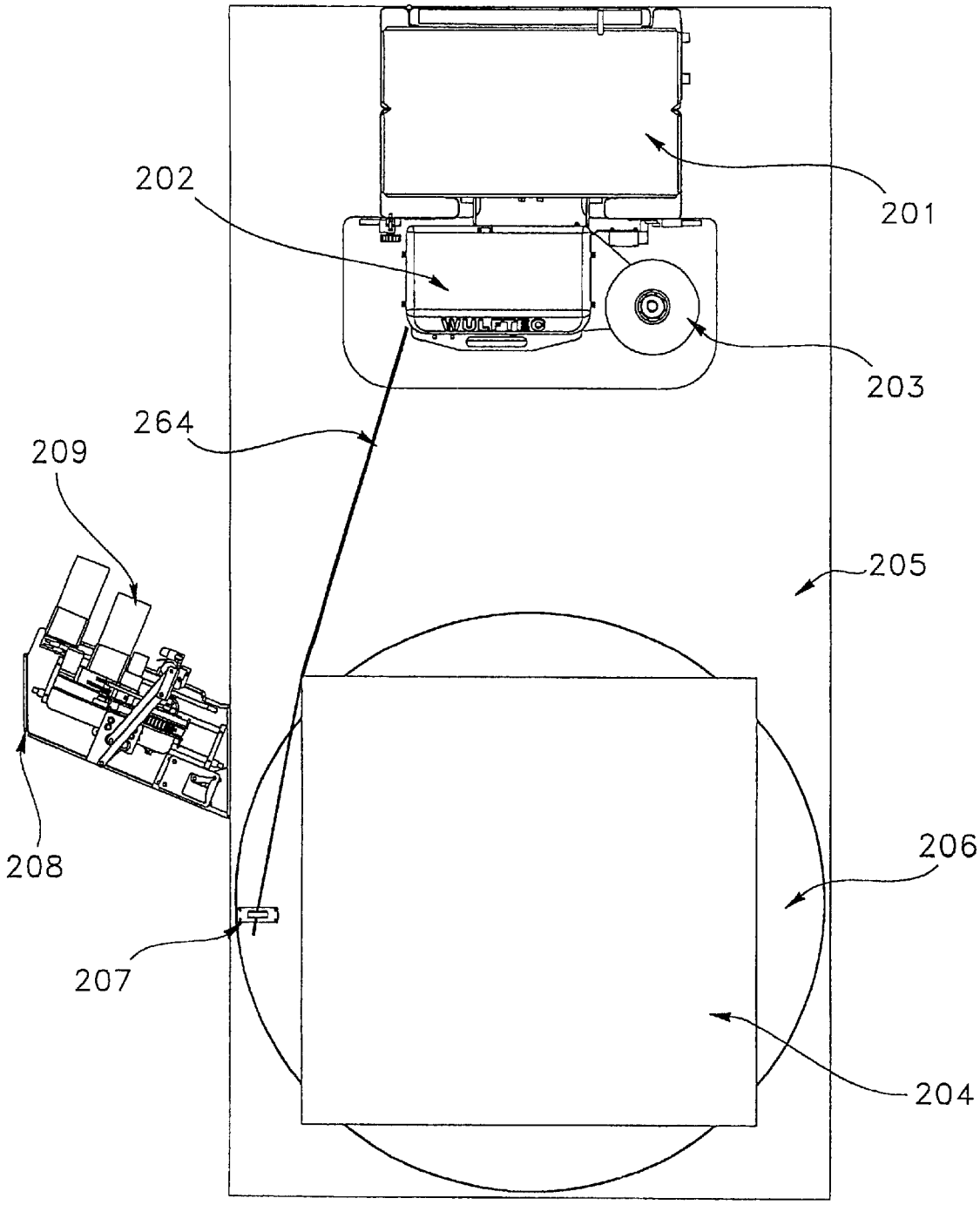
FIG. 31 is a top view of the wrapping machine with the third preferred embodiment with the article, in a different operating position.
Figure 32:
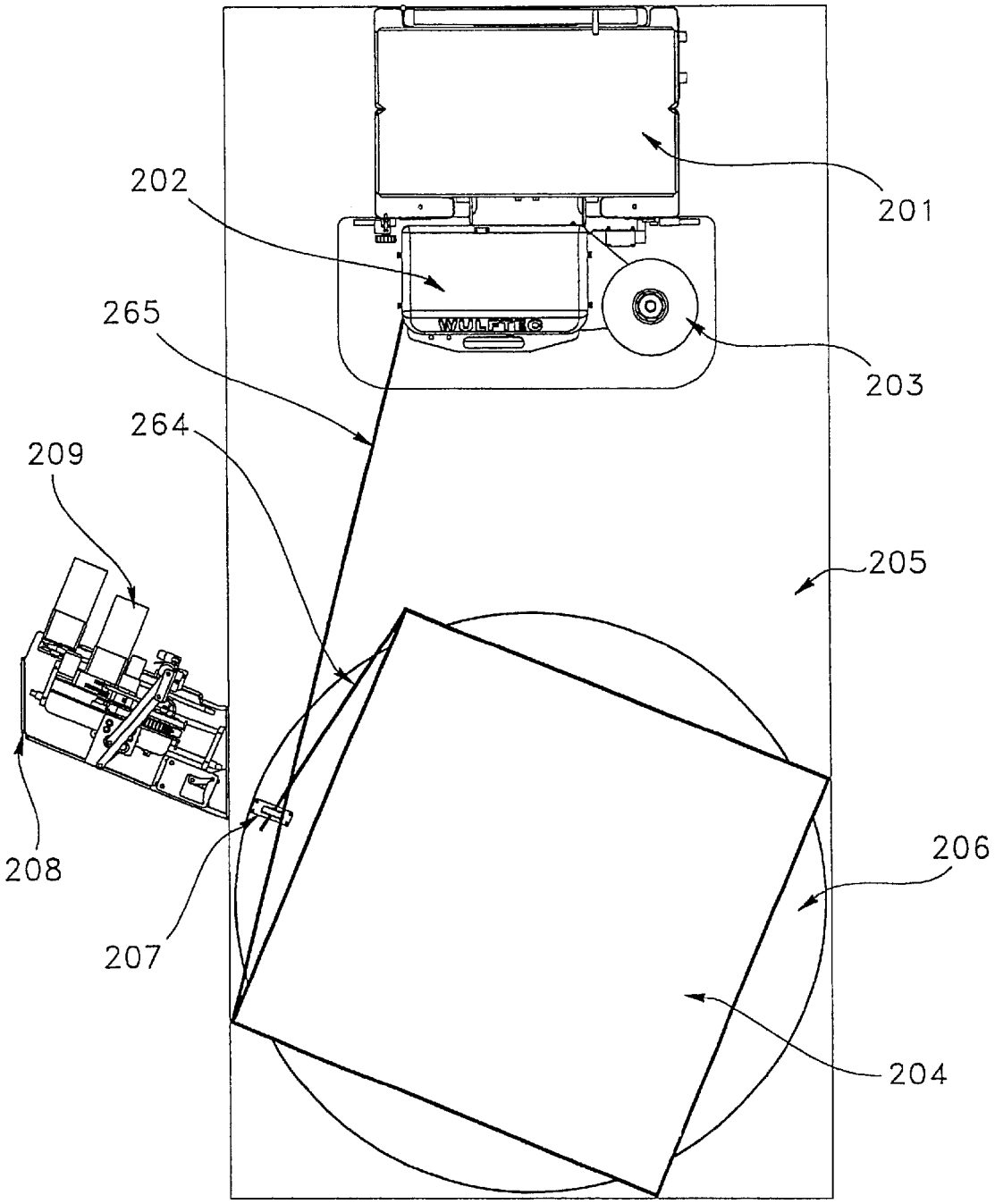
FIG. 32 is a top view of the wrapping machine with the third preferred embodiment, with the article, in a different operating position.

To start a new cycle, the operator places the rope 264 delivered by the carriage 202 into the table clamp 207 as shown in FIG. 30. An article 204 to be wrapped is brought up unto the rotary table 206 as shown in FIG. 31. The cycle is started and the article 204 is wrapped by means of a conventional method. During the last revolution of the table 206, the film of the film roll 203 is turned from a web into a rope 265 by means of the carriage 202. The table 206 is then stopped at approximately ⅛ of a turn from its home position as shown in FIGS. 32 to 34.

Figure 33:
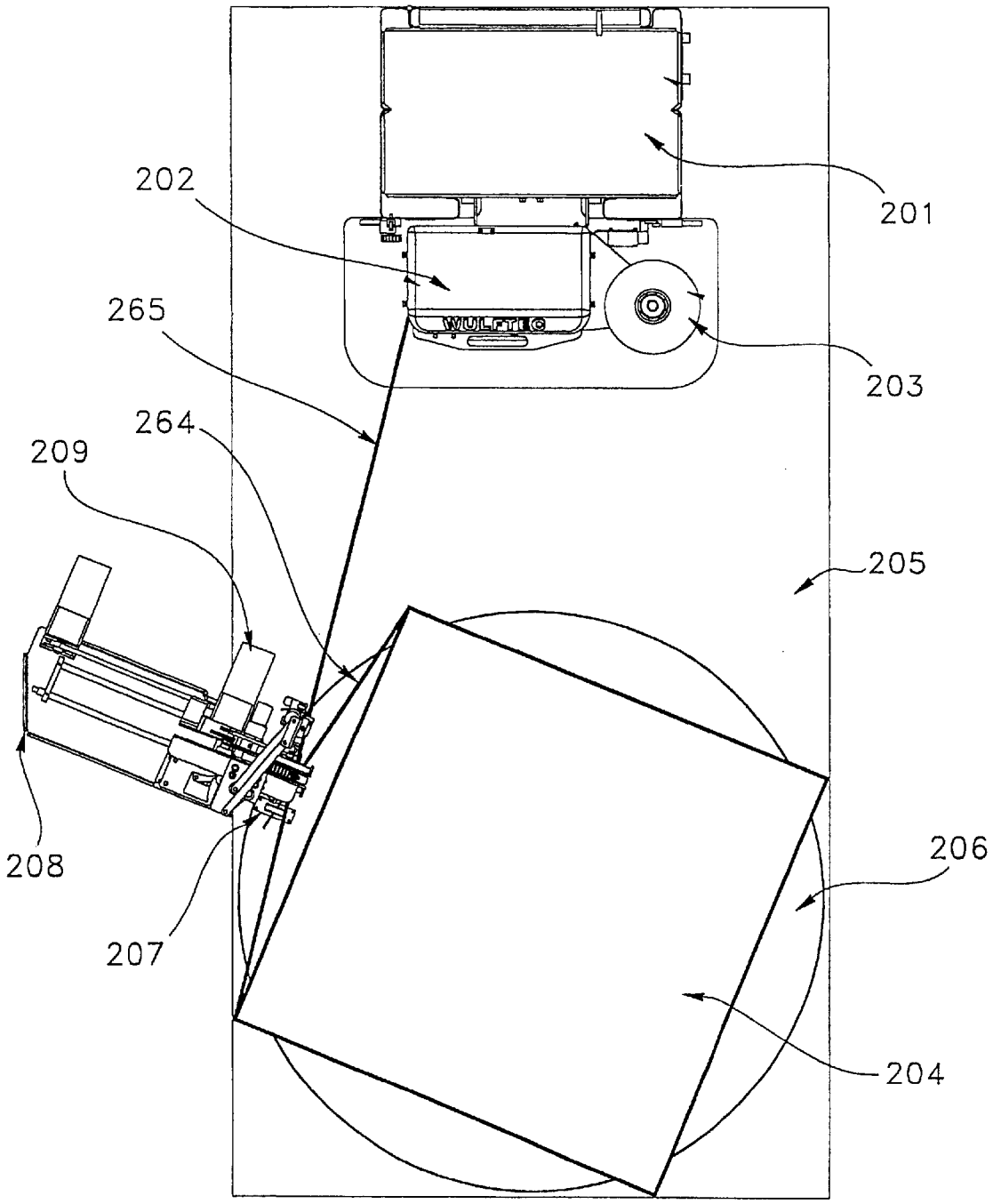
FIG. 33 is a top view of the wrapping machine with the third preferred embodiment, with the article, in a different operating position.
Figure 34:
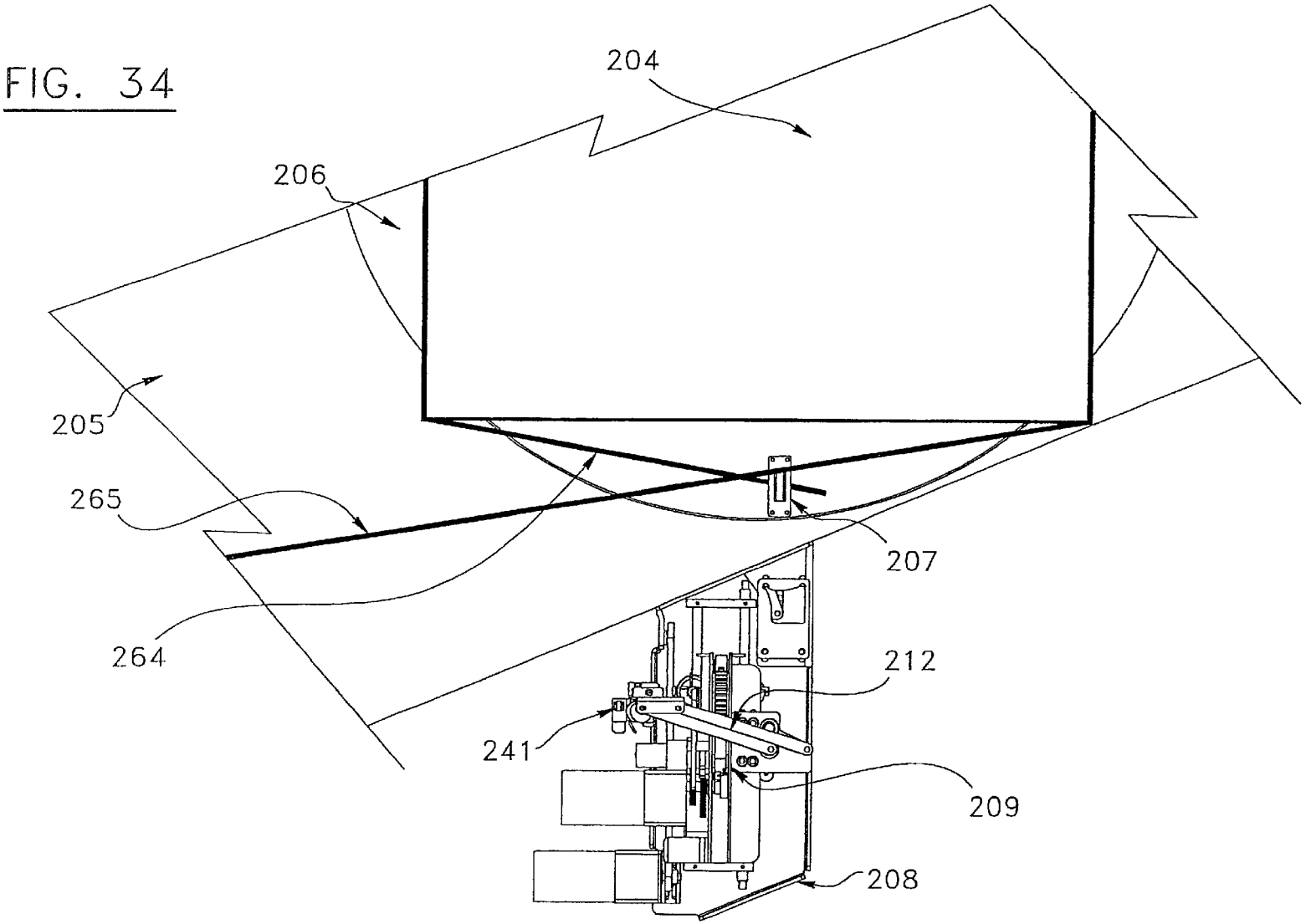
FIG. 34 is a partial top view of the third preferred embodiment, with the article, in a different operating position.
Figure 35:
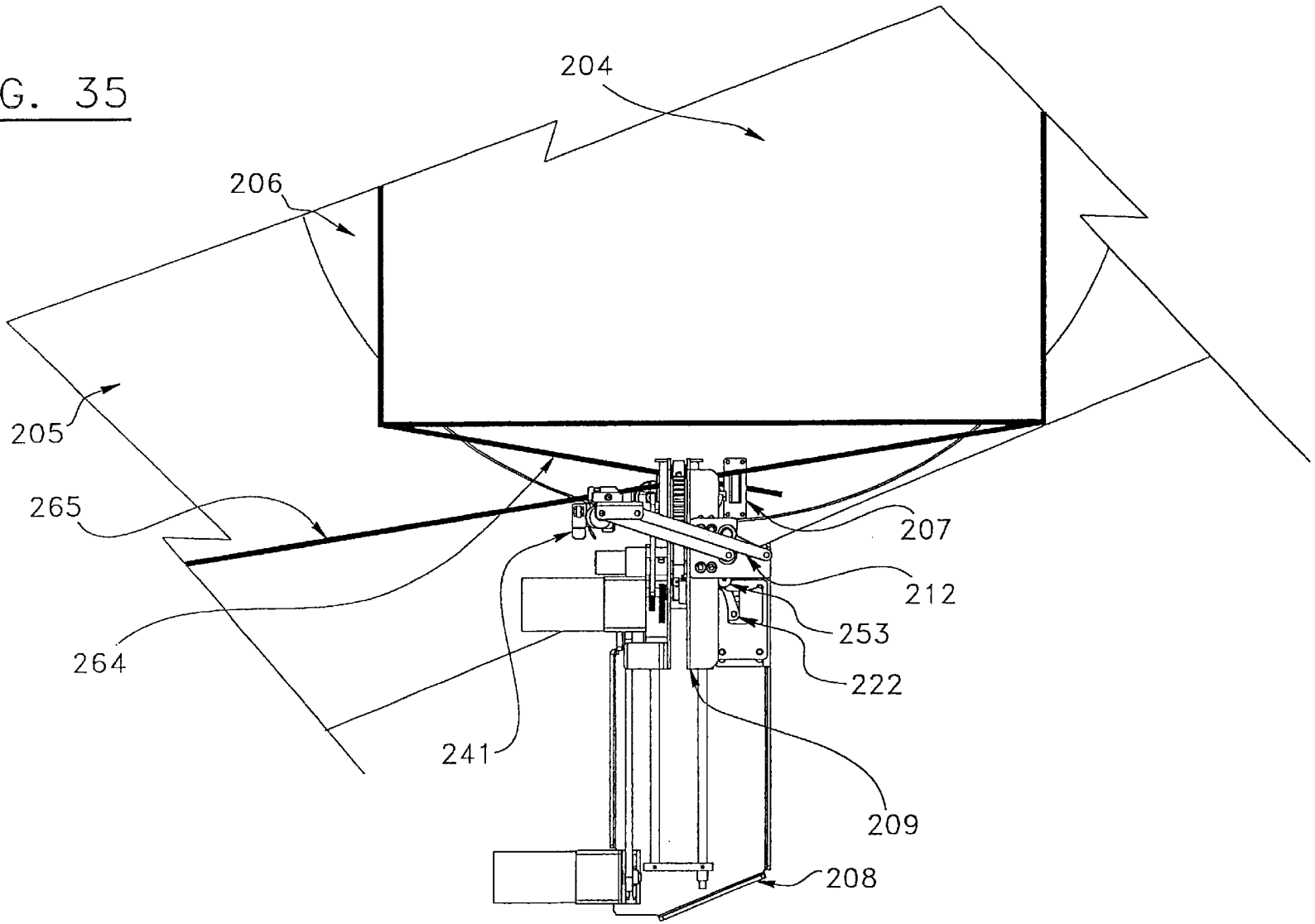
FIG. 35 is a partial top view of the third preferred embodiment, with the article, in a different operating position.
Figure 39:
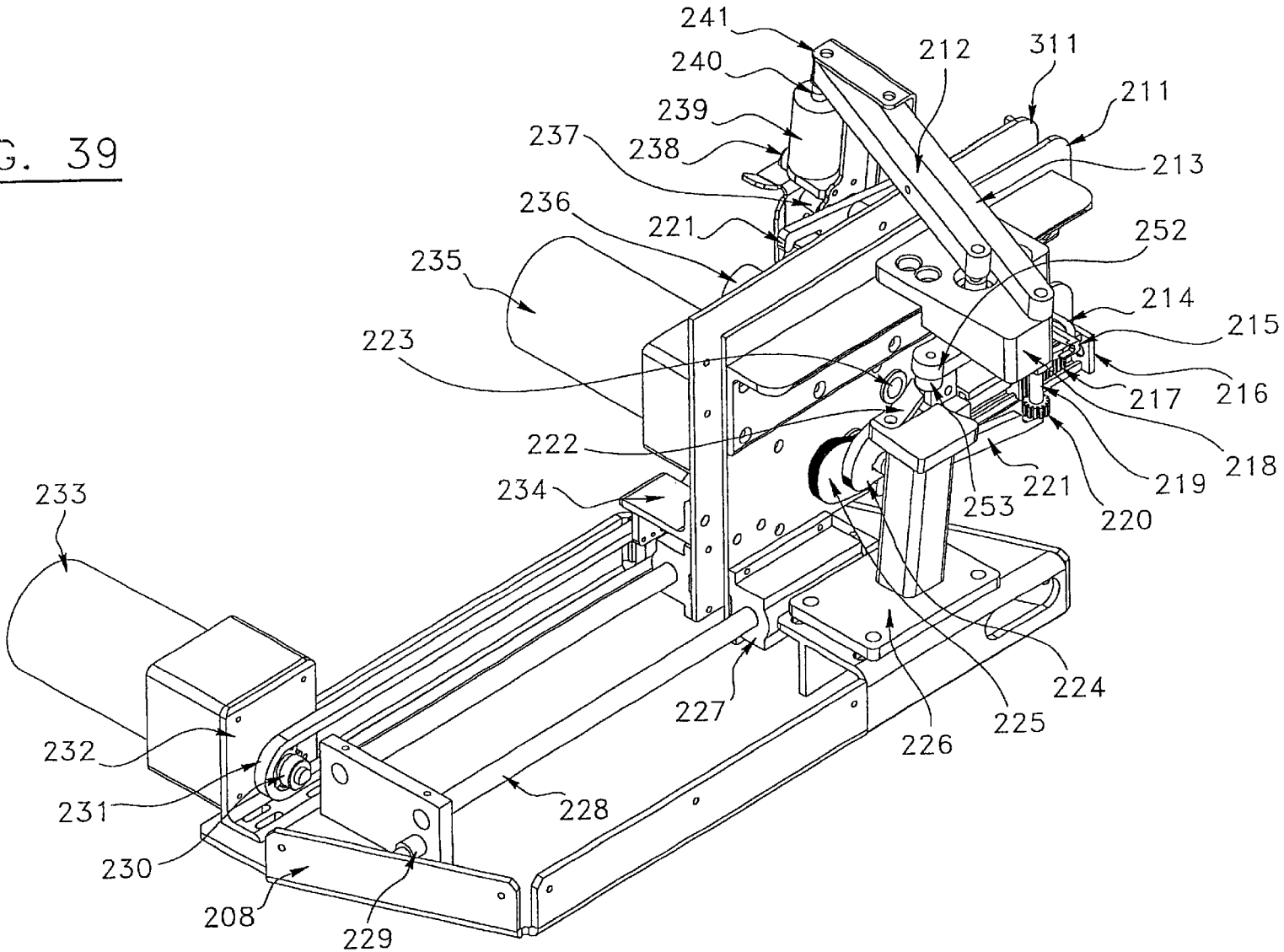
FIG. 39 is a perspective view of the third preferred embodiment.
Figure 40:
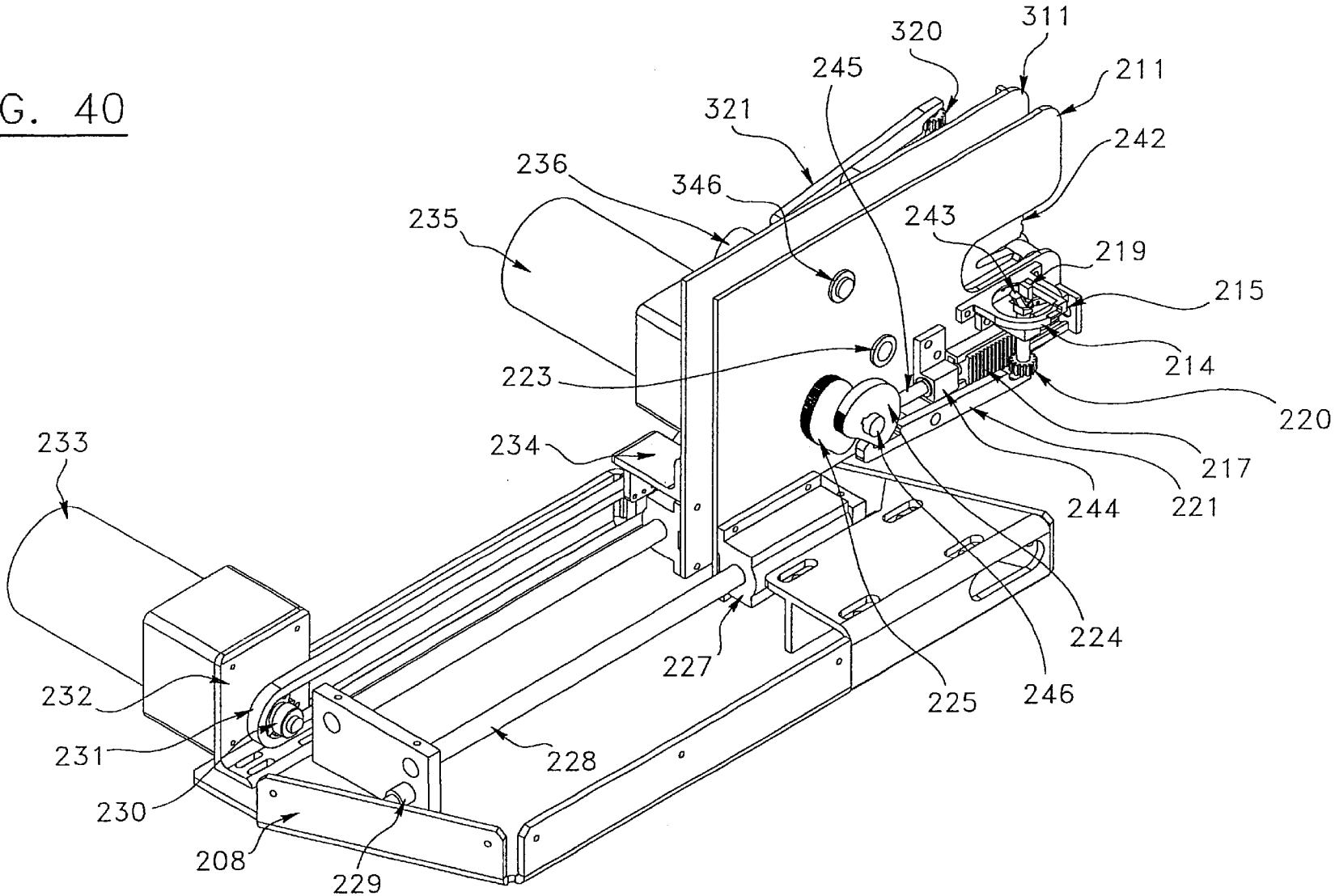
FIG. 40 is a partial perspective view of the third preferred embodiment where certain elements thereof have been removed.
Figure 41:
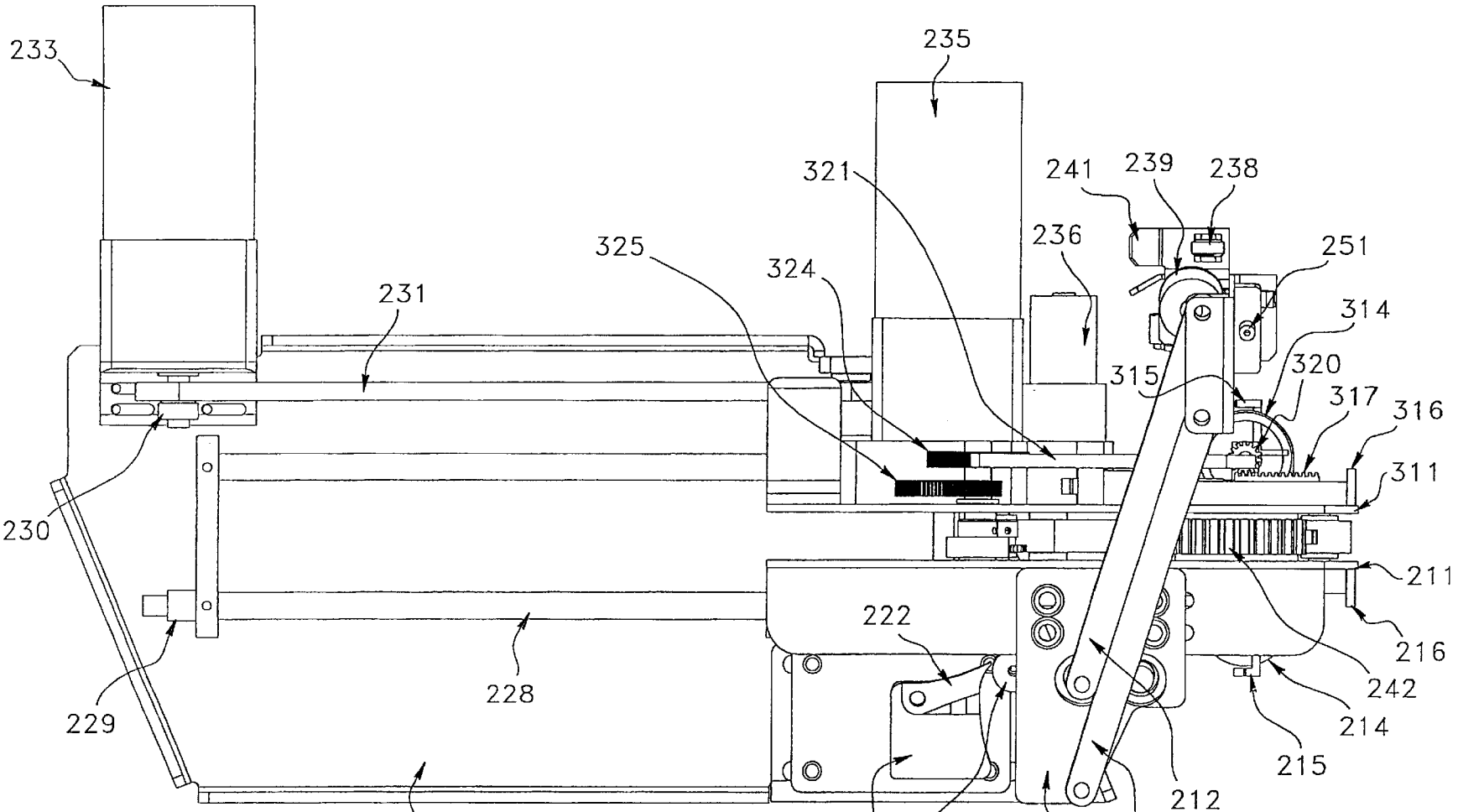
FIG. 41 is a top view of the third preferred embodiment.
Figure 42:
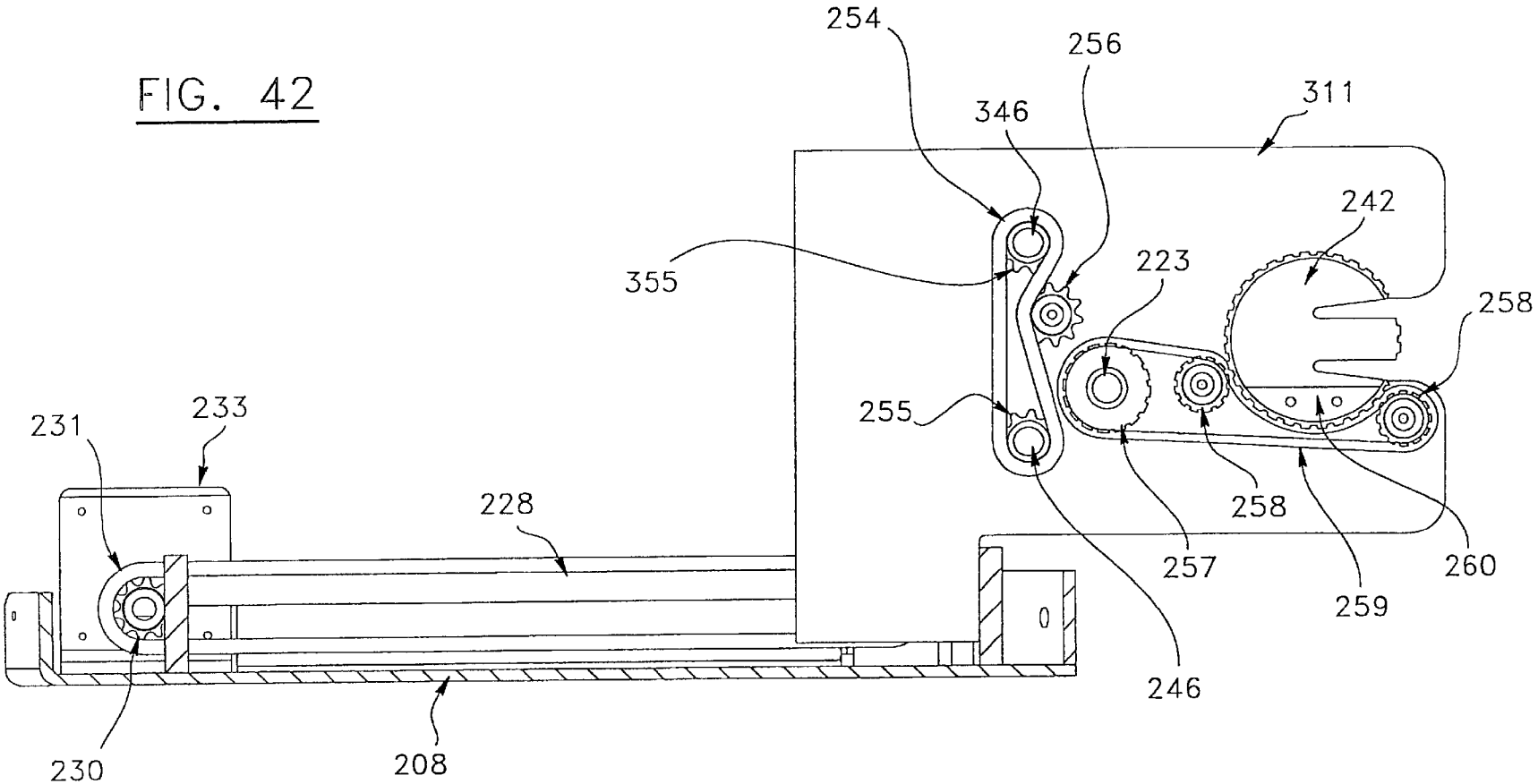
FIG. 42 is a side view of the third preferred embodiment where certain elements thereof have been removed.
Figure 43:
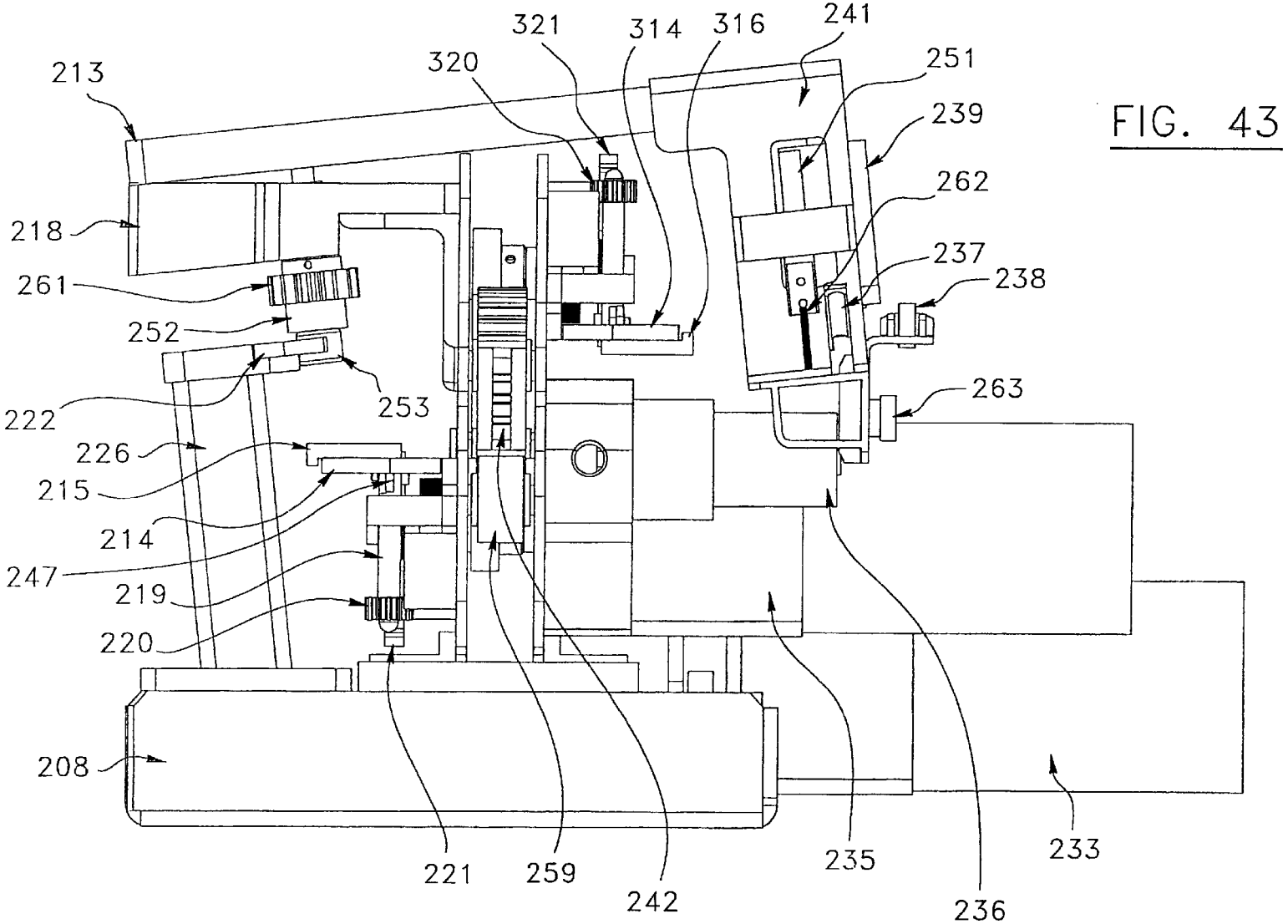
FIG. 43 is a front view of the third preferred embodiment.
Figure 44:
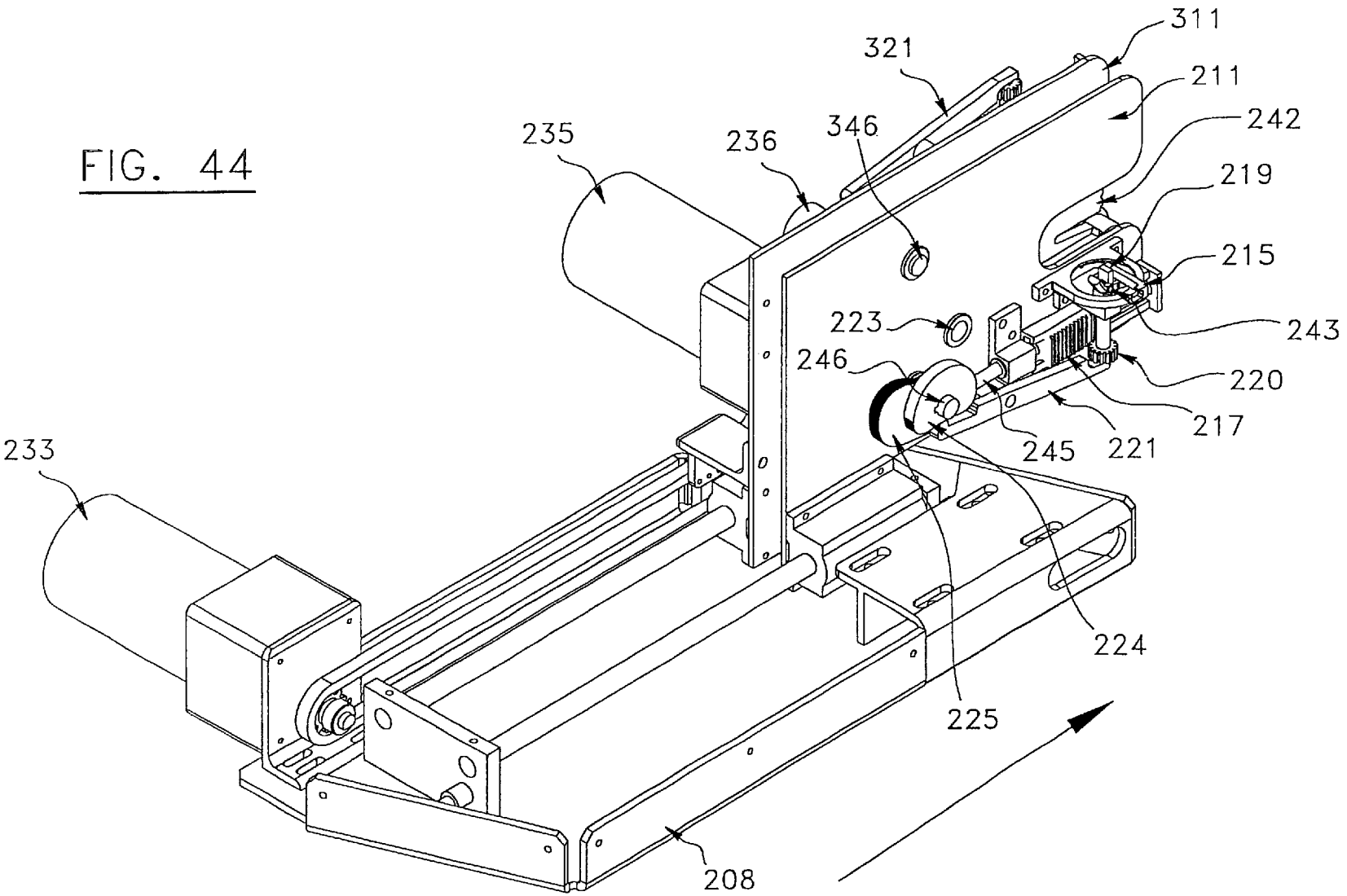
FIG. 44 is a perspective view of the third preferred embodiment in a first operating position.
Figure 45:
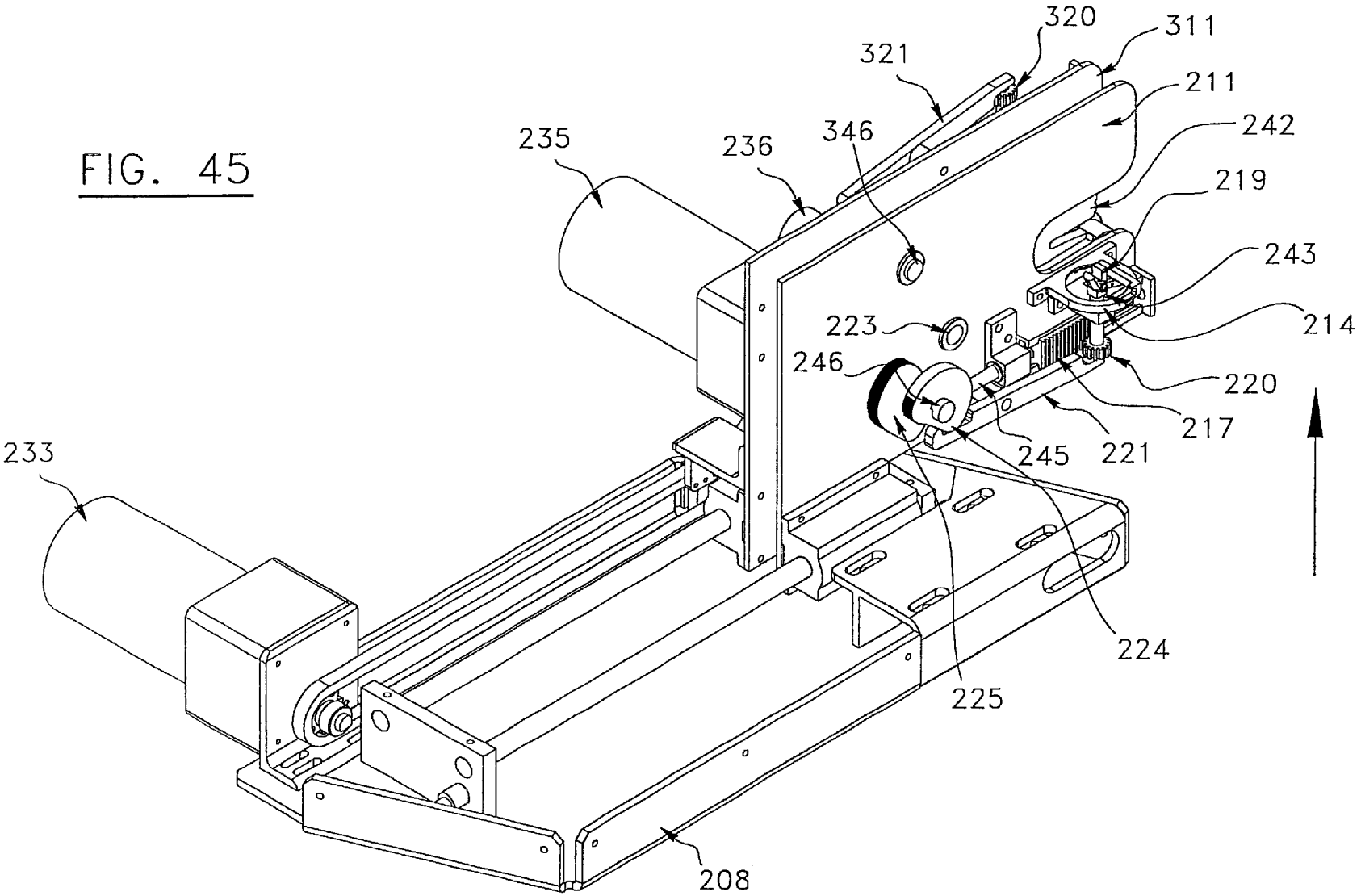
FIG. 45 is a perspective of the third preferred embodiment in a second operating position.
Figure 46:
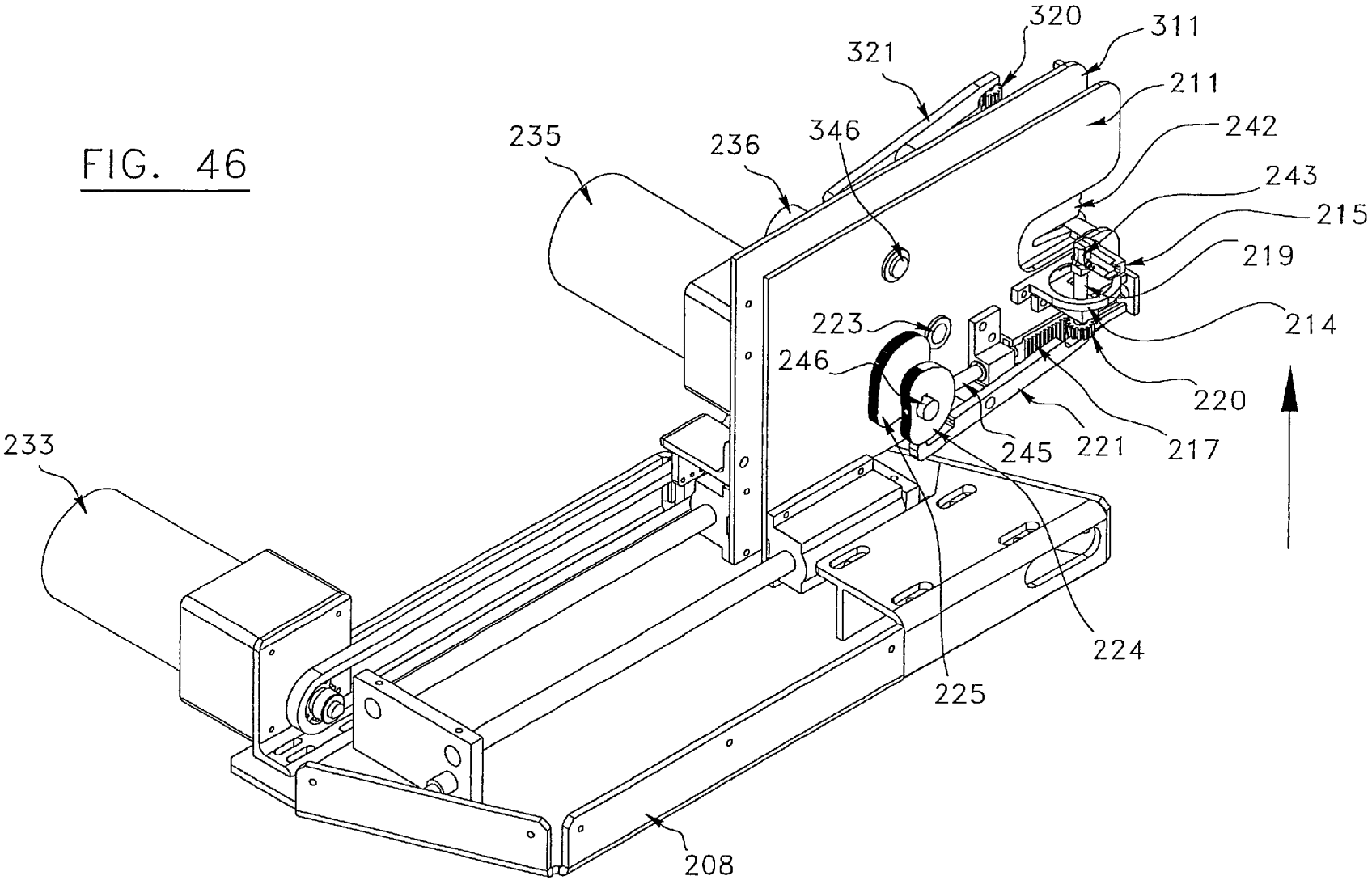
FIG. 46 is a perspective view of the third preferred embodiment in a third operating position.
Figure 47:
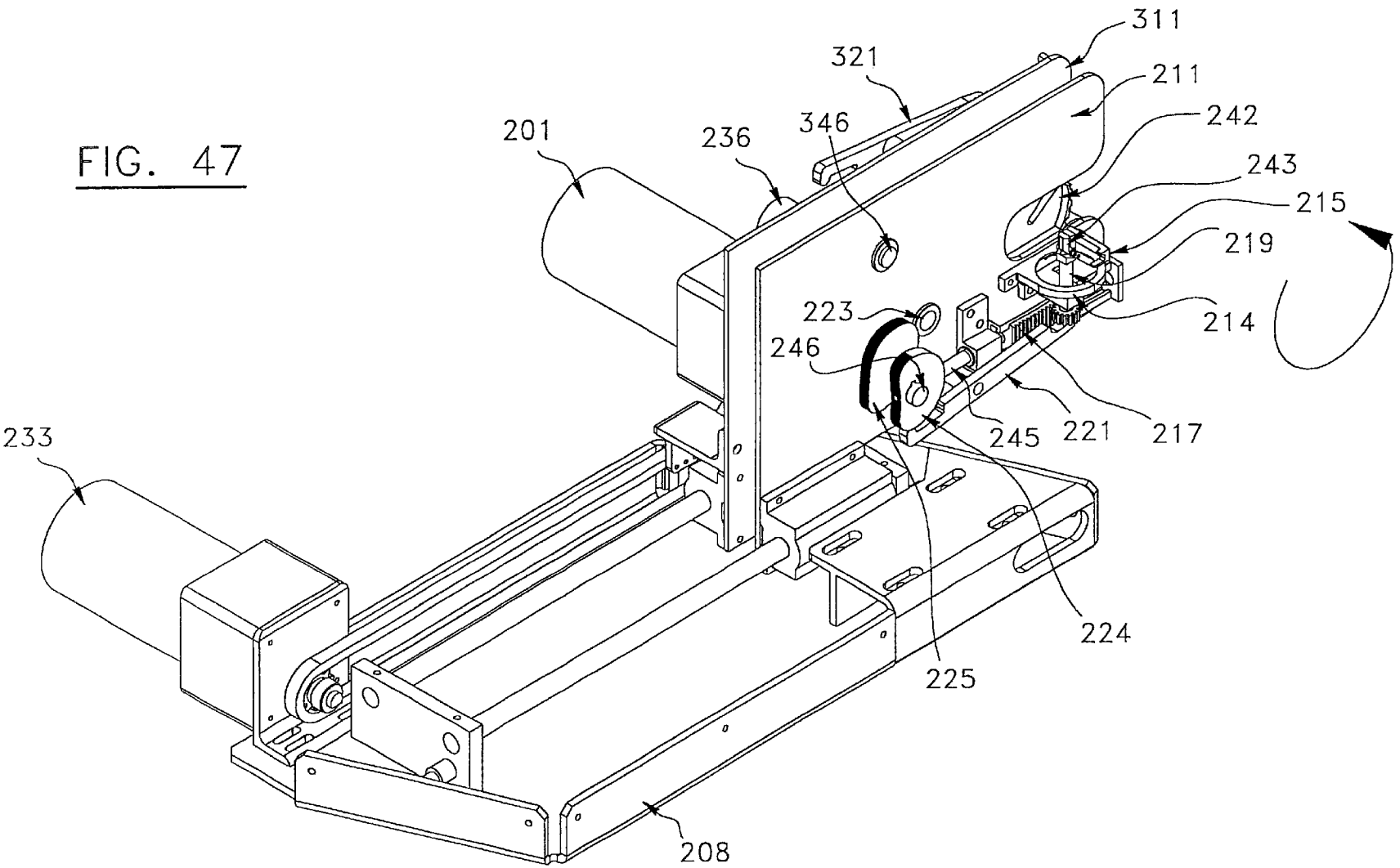
FIG. 47 is a perspective view of the third preferred embodiment in a fourth operating position.
Figure 48:
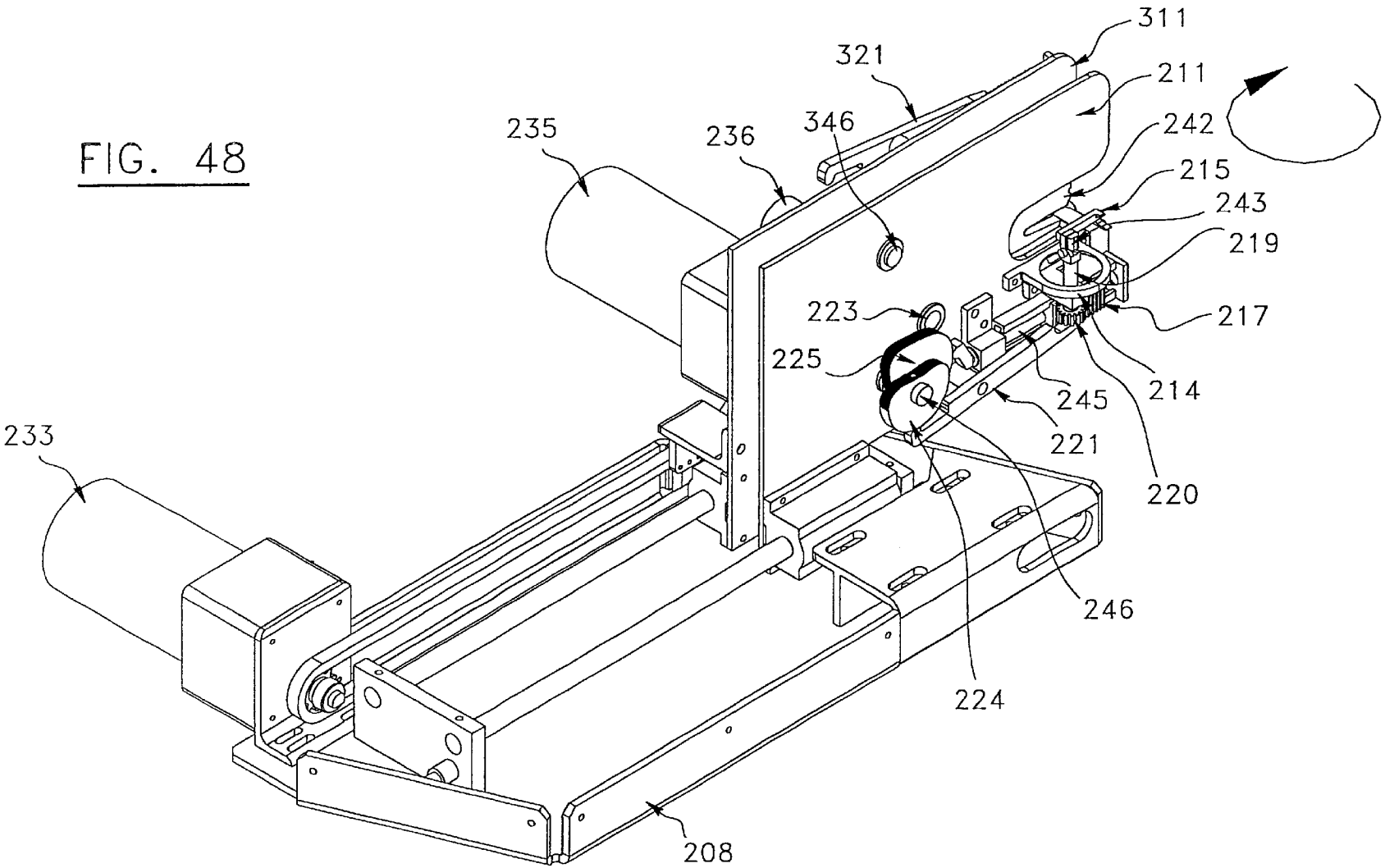
FIG. 48 is a perspective view of third preferred embodiment in a fifth operating position.
Figure 49:
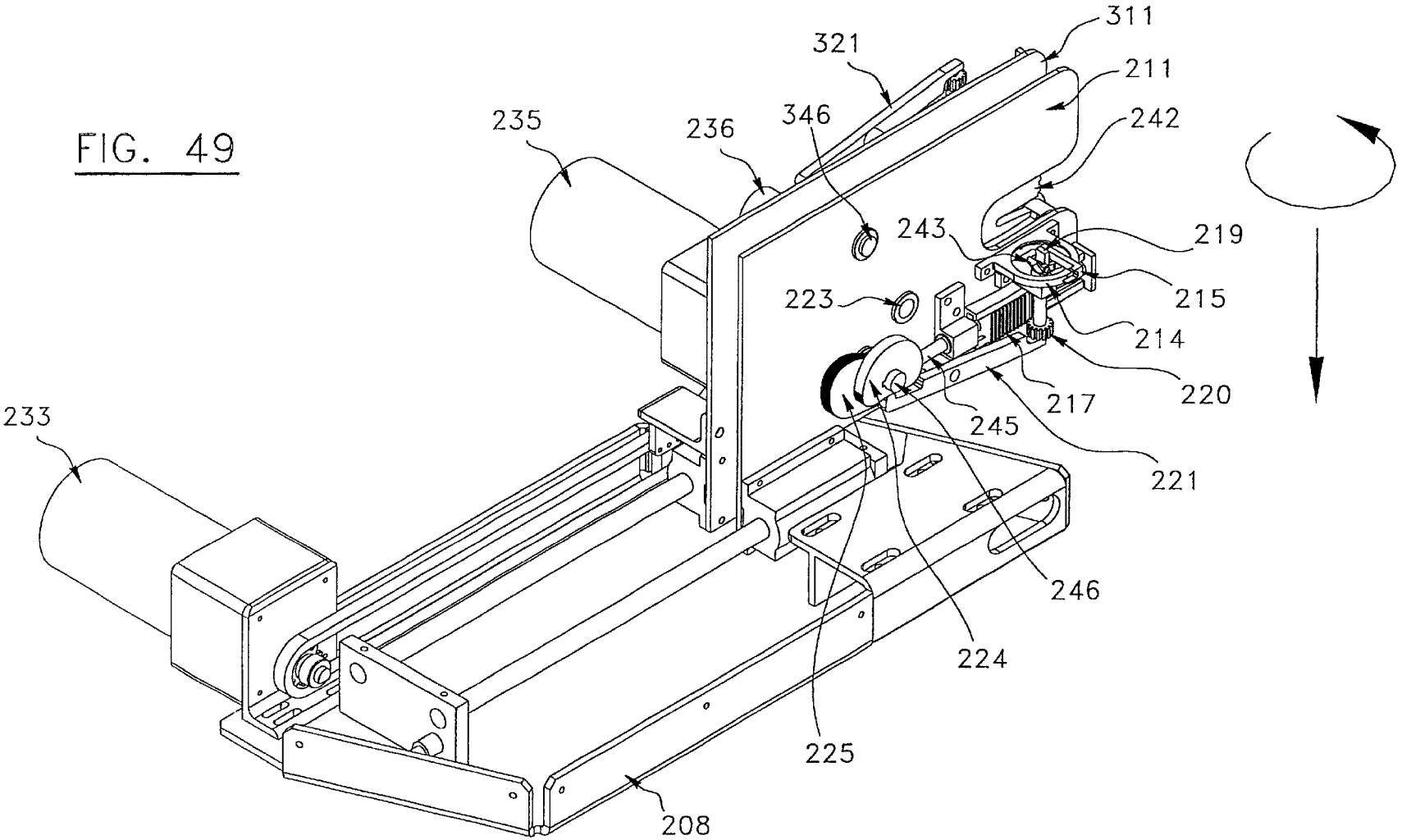
FIG. 49 is a perspective view of the third preferred embodiment in a sixth operating position.

The knotter head is brought from its home position to its knotting position, as shown for example in FIG. 33, by means of gear motor 233, the linear bearing 227 and guide shaft 228 shown in FIG. 39. As the knotter head is moved to its knotting position, the two ropes 264 and 265 are automatically guided in the rotation head 242, the rope 264 in the bottom slot and the rope 265 in the top slot. The rope 264 is then clamped by means of gear motor 235 that drives a shaft 246 on which a cam 224 produces a lifting movement via the clamp jaw 219 by means of a lifter arm 221. As the clamp jaw 219 is moved upwardly, the movable jaw 243 grips the rope 264 as it hits clamp jaw trigger 214. The clamp motion for clamping the rope 264 is from a down position to an up position. The rope 265 is also clamped by means of a gear motor 235 that activates a shaft on which a cam 324 produces a lifting movement via a clamp jaw by means of lifter 321. As the clamp jaw is moved downwardly, a movable jaw grips the rope 265 as it hits the clamp jaw trigger 314. The motion for clamping the rope 265 is from a top position to a down position. Both motions are symmetrical and linked with a chain 254 and sprockets 255 and 355 as shown in FIG. 42.

The rope 265 is simultaneously clamped a second time by means of clamp jaw 237 mounted on the transfer arm 212 by activating clamp solenoid 239. After being clamped, the heat wire 262 is activated to cut the rope 265 between the transfer clamp frame 241 and the clamp jaw. Then gear motor 236 is activated to rotate the rotation head 242. After a full turn thereof, a loop is obtained. The gear motor 235 is activated again to drive the shafts 246 and 346 on which cams 225 and 325 are respectively mounted. As the cams 225 and 325 are turning, a pushing motion is produced by means of rack pushpin 245 and another rack pushpin. The linear motion of rack pushpin 245 and the other rack pushpin is transformed into a rotary motion by means of racks 217 and 317 and pinions 220 and 320. The rotary motion induces a rotation of push arms 215 and 315 with clamp jaw 219 and another clamp jaw. The push arms 215 and 315 push the two ends of the ropes 264 and 265 into the loop previously produced by the rotation head 242.

When the rope tails are in the loop, the action of the cams 225 and 325 brings push arms 215 and 315 to their initial position leaving the tails of the ropes 264 and 265 into the loop. Simultaneously, the action of the cams 224 and 324 brings the clamp jaw 219 and the other clamp jaw back to their initial position. As clamp jaw 219 and the other clamp jaw are moved back, the ropes 264 and 265 are released from movable jaw 243 and another movable jaw by means of springs. The knot 266 is now made and is freed from the knotter head. All the movements are accomplished during a single revolution of the shafts 246 and 346 and cams 224, 324, 225 and 325.

Figure 36:
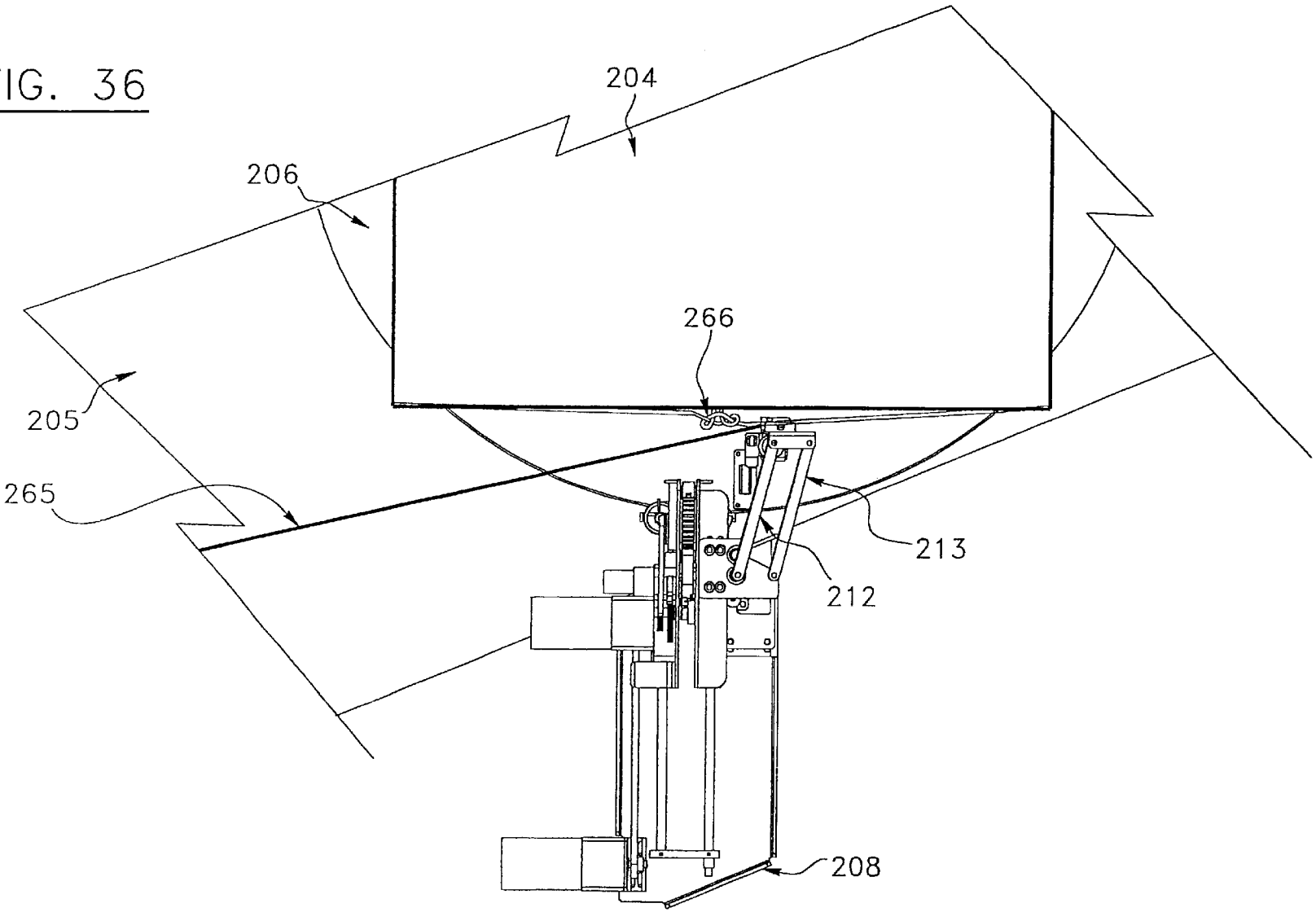
FIG. 36 is a partial top view of the third preferred embodiment, with the article, in a different operating position.
Figure 37:
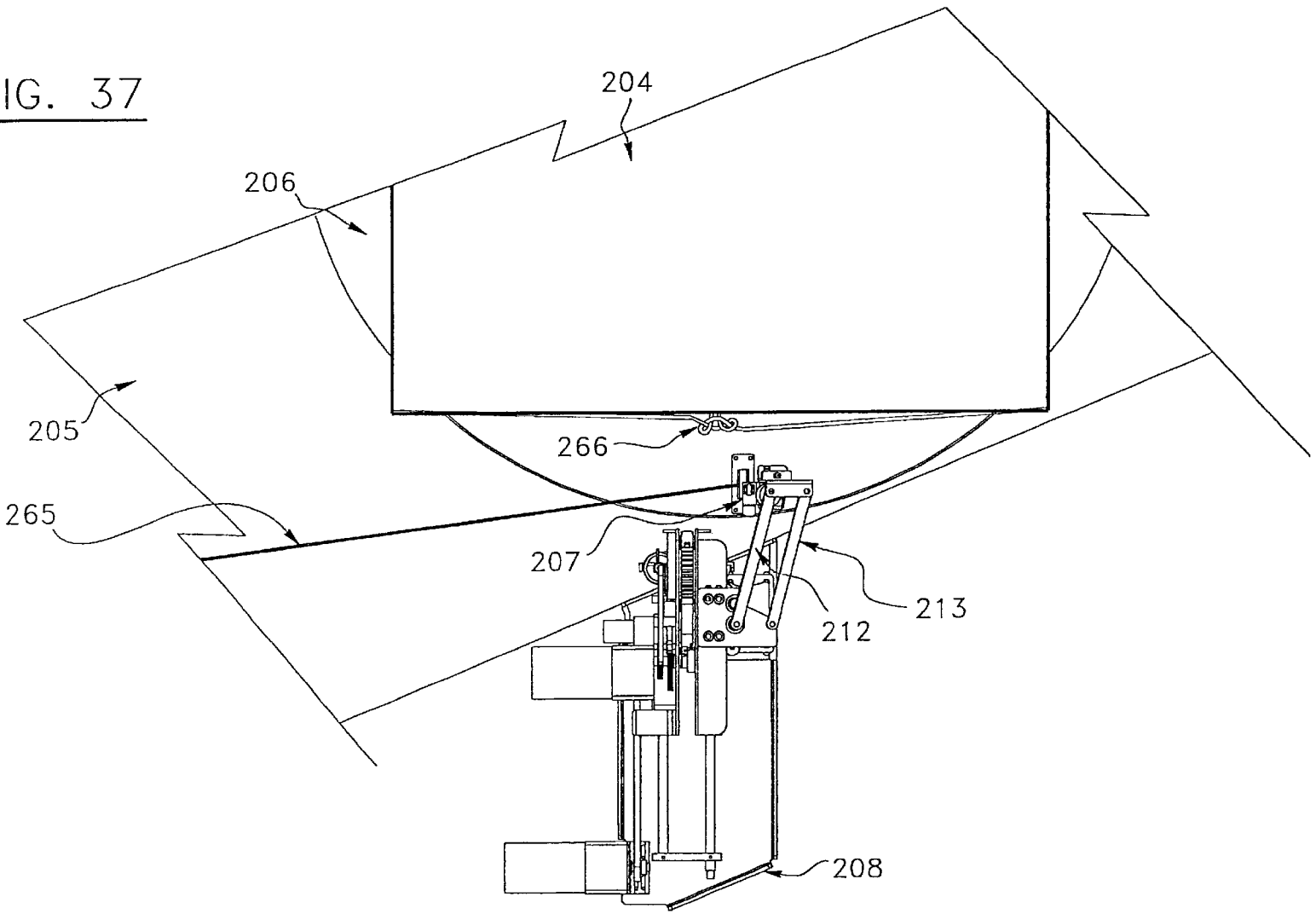
FIG. 37 is a partial top view of the third preferred embodiment, with the article, in a different operating position.
Figure 38:
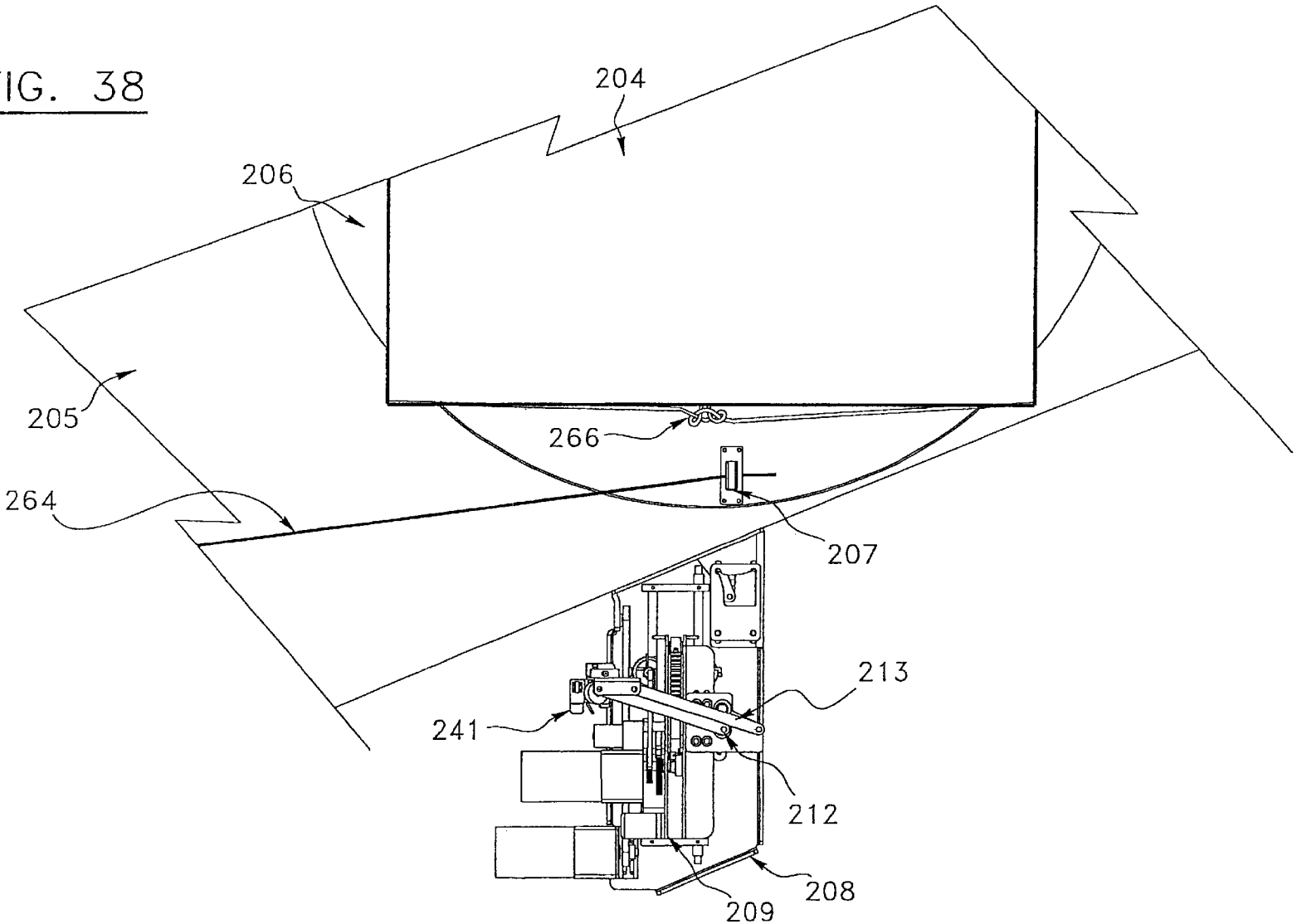
FIG. 38 is a partial top view of the third preferred embodiment, with the article, in a different operation position.

The knotter head then moves backward by means of gear motor 233. As it is moving backward, the transfer arm cam follower 253 mounted on the transfer arm lever 252 hits the transfer arm trigger 222. The transfer arm trigger 222 is spring loaded to activate the transfer arm lever 252 only upon the backward movement of the knotter head and not when it moves forward. As it hits the transfer arm trigger 222, the transfer arm cam follower 253 follows a path that makes the transfer arm 212 move to the other side of the knotter head as shown in FIG. 36. The rope 265 which is clamped by the transfer clamp 241 is now pulled to the other side of the knotter head. As the knotter head keeps moving backwards, the transfer clamp 241 extends over the table clamp 207 and the table clamp trigger 263 opens a table clamp movable jaw that is spring loaded. The rope 265 is simultaneously engaged in the table clamp 207 and released from the transfer clamp 241 as shown in FIG. 37. As the backward movement of the knotter head is completed, the transfer arm cam follower 253 leaves the transfer arm trigger path and is brought back to its home position. The rotary table can now complete the last ⅛ of revolution to its home position and the wrapped article 204 can be removed. The rope 265 becomes the rope 264 for the next cycle.

Figure 50:
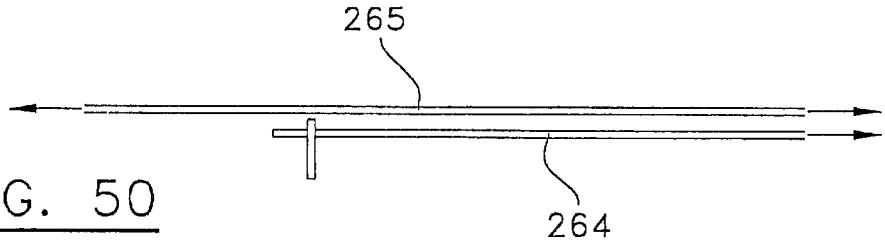
FIG. 50 is a schematic view of the rope-shaped end portions to be knotted according to the third preferred embodiment, in a first operating position.

Referring now to FIGS. 50 to 55, we will describe the method for making a knot according to the third preferred embodiment. FIG. 50 illustrates the first step where at the end of the wrapping cycle, the first rope 264 is held by a table clamp and the second rope 265 extends between the article and the carriage. The ropes 264 and 265 are placed in parallel to each other. The first rope 264 is on the bottom. The knotter head is brought forward in position and the two ropes 264 and 265 slide in their appropriate slots in a rotating head.

Figure 51:
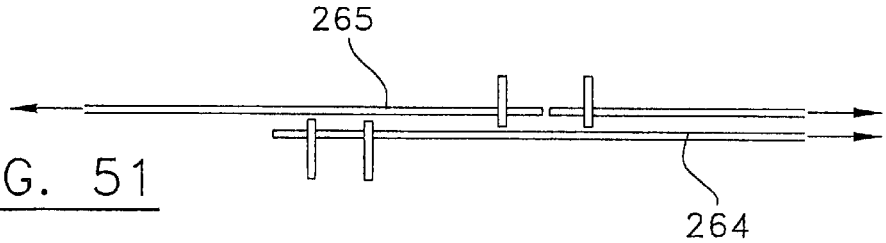
FIG. 51 is a schematic view of the rope-shaped end portions to be knotted according to the third preferred embodiment, in a second operating position.

Referring now to FIG. 51, there is shown step 2, where once in position, the knotter head clamps the two ropes 264 and 265 one on each side of the head. The second rope 265 is simultaneously clamped by the transfer arm clamp and is cut between rotation head clamp and the transfer arm.

Figure 52:
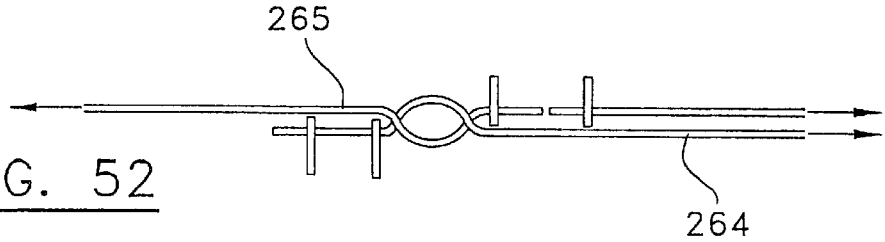
FIG. 52 is a schematic view of the rope-shaped end portions to be knotted according to the third preferred embodiment, in a third operating position.

Referring now to FIG. 52, there is shown step 3 where the rotation head performs a complete revolution which produces a loop between the two ropes 264 and 265.

Figure 53:
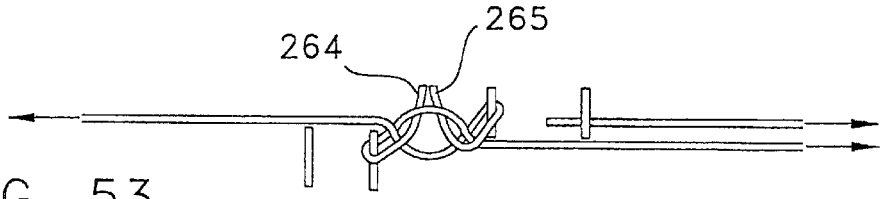
FIG. 53 is a schematic view of the rope-shaped end portions to be knotted according to the third preferred embodiment, in a fourth operating position.

Referring now to FIG. 53, there is shown step 4 where the clamp push arm pushes the two free ends of the ropes 264 and 265 into the loop as it rotates.

Figure 54:
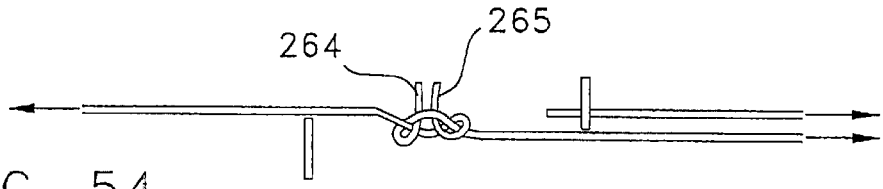
FIG. 54 is a schematic view of the rope-shaped end portions to be knotted according to the third preferred embodiment, in a fifth operating position.

Referring now to FIG. 54, there is shown step 5 where the knotter head clamp releases the ropes and the knotter head moves backward to its home position.

Figure 55:
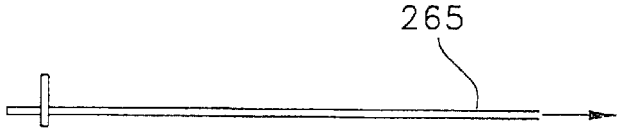
FIG. 55 is a schematic view of the remaining rope-shaped end portion once the knot has been completed according to the third preferred embodiment.

Referring now to FIG. 55, there is shown step 6 where as the knotter head moves back, the transfer arm brings the remaining rope 265 into the table clamp jaw and releases it to finish its movement to its home position.

Although preferred embodiments of the invention have been described in details herein and illustrated in the accompanying drawings, it is to be understood that the invention is not limited to these precise embodiments and that various changes and modifications may be effected therein without departing from the scope or spirit of the invention.

What is claimed is:

1. A method of making a knot with first and second rope-shaped end portions of flexible material wrapped around an article, comprising steps of:

(a) guiding the end portions along a predetermined path;

(b) (i) nipping the first end portion at a first point of the predetermined path, (ii) nipping the second end portion at a second point of the predetermined path, and (iii) nipping the second end portion at a third point of the predetermined path;

(c) cutting the second end portion between the second and third points to obtain a free end thereof;

(d) moving the end portions to obtain a loop;

(e) releasing the first end portion from the guiding of step (a) to obtain a free end thereof; and (f) inserting the free ends into the loop to form and tighten the knot.

2. A method according to claim 1, wherein:

step (e) is performed after substeps (i) and (ii) and before substep (iii);

step (d) is performed after step (c) and comprises rotating the free ends around a hollow shaft having an end opening to obtain the loop; and step (f) comprises (iv) gripping and moving the free ends to place portions thereof over the end opening, and (v) gripping and inserting said portions of the free ends into the hollow shaft thereby inserting the free ends into the loop.

3. A method according to claim 1, wherein in step (a) the end portions are guided in parallel along the predetermined path.

4. A method according to claim 1, wherein step (c) includes steps of heating a heat wire, and moving the heat wire transversally with respect to the second end portion.

5. An apparatus for making a knot with first and second rope-shaped end portions of flexible material wrapped around an article, comprising:

a controllable holder for holding a free end of the first end portion;

controllable guides for guiding the end portions along a predetermined path;

first controllable nippers for nipping the first end portion at a first point of the predetermined path;

second controllable nippers for nipping the second end portion at a second point of the predetermined path;

third controllable nippers for nipping the second end portion at a third point of the predetermined path;

a controllable cutter for cutting the second end portion between the second and third points to obtain a free end thereof;

first controllable moving means for moving the end portions to obtain a loop; and second controllable moving means for moving the free ends into the loop to form and tighten the knot.

6. An apparatus according to claim 5, wherein:

the controllable holder and the third controllable nippers consist of a single gripper; and the first and second controllable nippers consist of an assembly.

7. An apparatus according to claim 6, wherein the gripper comprises:

first and second jaws, the second jaw being movable with respect to the first jaw between a first position where the second jaw operatively rests against the first jaw and a second position where the second jaw is away from the first jaw; and an actuating element connected to the second jaw for moving said second jaw between the first and second positions thereof.

8. An apparatus according to claim 6, wherein the assembly comprises:

first and second jaws, the first jaw being a cylindrical element, the second jaw being a finger movable between a first position where an end thereof operatively rests against the cylindrical element and a second position where said end of the finger is away from the cylindrical element; and third controllable moving means for moving the finger between its first and second positions.

9. An apparatus according to claim 8, wherein the third controllable moving means comprise first and second cooperating members, the first member having a cavity with a peripheral wall, the second member being at least partially mounted within the peripheral wall of the cavity and rotatable thereabout, the second member having a guiding groove for guiding the finger along a radial direction with respect to the cylindrical element, the finger being pushed from its second position toward its first position by a rotational movement of the second member with respect to the first member upon a pressure exerted by the peripheral wall on the finger.

10. An apparatus according to claim 9, wherein:

the first and second cooperating members are provided with a central opening; and the assembly further comprises an actuator for moving the first and second members between a first position where the cylindrical element projects from the central opening in position for cooperating with the finger and a second position where the cylindrical element is retracted from the central opening.

11. An apparatus according to claim 10, wherein the second member has an upper surface provided with a straight off-center groove that crosses said upper surface from one side thereof to another via a peripheral portion of the central opening, the off-center groove being sized for receiving the end portions, the off-center groove being provided, along a portion thereof extending from the central opening to the periphery of the upper surface, with a bias shoulder.

12. An apparatus according to claim 11, wherein the first controllable moving means are embodied by the assembly, the loop being obtained by rotating the second member with respect to the cylindrical element when the first and second members are in their first position thereby looping the free ends around the cylindrical element.

13. An apparatus according to claim 12, wherein:

the cylindrical element is hollow with an open end; and the second controllable moving means comprise a first pair of jaws movable between a first position where said first pair of jaws is in position to grip the free ends of the end portions once the looping thereof around the cylindrical element has been performed to a second position where a part of the free ends faces the open end of the cylindrical element, and a second pair of jaws movable between a first position where said second pair of jaws is in position to receive and grip the part of the free ends facing the open end of the cylindrical element to a second position where said free ends are inserted into the loop to form and tighten the knot.

14. An apparatus according to claim 7, wherein the controllable guides comprise:

a groove shaped element formed by the first and second jaws when the second jaw is in its first position to hold the free end of the first end portion and guide the second end portion extending between the article and a material delivering device; and two groove shaped stops movable between a first position where the stops are distal from each other and a second position where the stops are adjacent to guide the end portions extending between the groove shaped element and the article thereby defining the predetermined path between the groove shaped element and the stops.

15. An apparatus according to claim 5, further comprising an actuating element connected to the controllable cutter for moving the cutter between a first position where the cutter is in position for cutting the second end portion and a second position where the cutter is in a position remote from the second end portion.

16. An apparatus according to claim 15, wherein the controllable cutter is a heated wire cutter.

* * * * *